US007257534B2

(12) United States Patent
Saito et al.

(10) Patent No.: US 7,257,534 B2
(45) Date of Patent: Aug. 14, 2007

(54) SPEECH SYNTHESIS SYSTEM FOR NATURALLY READING INCOMPLETE SENTENCES

(75) Inventors: Natsuki Saito, Katano (JP); Takahiro Kamai, Souraku-gun (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 11/304,652

(22) Filed: Dec. 16, 2005

(65) Prior Publication Data

US 2006/0106609 A1 May 18, 2006

Related U.S. Application Data

(63) Continuation of application No. PCT/JP05/09131, filed on May 19, 2005.

(30) Foreign Application Priority Data

Jul. 21, 2004 (JP) ..... 2004-212649

(51) Int. Cl.
*G10L 13/08* (2006.01)

(52) U.S. Cl. ..... 704/260

(58) Field of Classification Search ..... 704/260
See application file for complete search history.

(56) References Cited

U.S. PATENT DOCUMENTS

| | | | |
|---|---|---|---|
| 6,026,360 A | 2/2000 | Ono | |
| 6,070,138 A | 5/2000 | Iwata | |
| 6,397,183 B1 | 5/2002 | Baba et al. | |
| 6,446,041 B1 | 9/2002 | Reynar et al. | |
| 6,853,962 B2 * | 2/2005 | Appleby | 703/2 |

FOREIGN PATENT DOCUMENTS

| | | |
|---|---|---|
| JP | 6-35913 | 2/1994 |
| JP | 9-179719 | 7/1997 |
| JP | 10-268896 | 10/1998 |
| JP | 11-161298 | 6/1999 |
| JP | 11-327870 | 11/1999 |
| JP | 2001-188777 | 7/2001 |
| JP | 2002-330233 | 11/2002 |
| JP | 2003-85099 | 3/2003 |

* cited by examiner

*Primary Examiner*—Susan McFadden
(74) *Attorney, Agent, or Firm*—Wenderoth, Lind & Ponack, L.L.P.

(57) ABSTRACT

To provide a speech synthesis apparatus which can prevent user confusion and deterioration of the quality of synthesized speech resulting from incompleteness of the sentences to be read out, and thus can read out speech which is easily understandable to the user. The speech synthesis apparatus includes: an incomplete part-of-sentence detection unit which detects incomplete parts-of-sentences which become linguistically incomplete because of the presence of a missing character string and which complements the detected incomplete parts-of-sentences having a missing character string, with reference to the e-mail texts which have been received by and accumulated in a mail box; a speech synthesis unit which generates synthesized speech based on the complemented e-mail texts; an incomplete part-of-sentence obscuring unit which obscures the acoustic clarity of the synthesized speech corresponding to the incomplete parts-of-sentences detected by the incomplete part-of-sentence detection unit; and a speaker device which plays back and outputs the generated synthesized speech.

8 Claims, 22 Drawing Sheets

FIG. 22

800

DAISAN CHI-MUNOSAITO-DESU .

GETSUYOBI NO MITINGU NI ATATTE ,
DONOYO NA SHIRYO WO YOI SUREBA
YOROSHII DESHO KA ? SHIKYU
OTSUTAE KUDASAI .

801

SUZUKI DESU .

>DONOYO NA SHIRYO WO YOI SURE BA

SENJITSU NO MITINGU NO NAIYO WO
MINA NI TSUTAETE KAKUNIN SURU
DAKE DESU KARA ,SORE WA SENJITSU
NO MITINGU DE SHIYO SHITA SHIRYO
NOMI DE DAIJOBU TO OMOIMASU .
PUROJEKUTA DE SETSUMEI SUREBA
YOI TO OMOI MASU GA ,SHIRYO A TO
B WA , 10 BU ZUTSU KOPI WO YOI
SHITE HAIFUSURU TO WAKARIYASUI
DESHO .

802

DAISAN CHI-MUNOSAITO-DESU .
>>DONOYO NA SHIRYO WO YOI SUREBA
>RE WA SENJITSU NO MITINGU DE SHIYO
>SHITA SHIRYO NOMI DE DAIJOBU TO OMOIMA
>(RYAKU)
>WA ,10 BU ZUTSU KOPI WO YOI SHITE
RYOKAI DESU . SOREDEWA YOROSHIKU ONEGAI
SHIMASU .

SPEECH SYNTHESIS SYSTEM FOR NATURALLY READING INCOMPLETE SENTENCES

CROSS REFERENCE TO RELATED APPLICATION

This is a continuation of PCT Patent Application No. PCT/JP05/09131, filed on May 19, 2005.

BACKGROUND OF THE INVENTION (1) Field of the Invention

The present invention relates to a speech synthesis apparatus which synthesizes speech corresponding to a text and outputs the synthesized speech, and in particular, to a speech synthesis apparatus for naturally reading out even incomplete sentences.

(2) Description of the Related Art

Conventionally, a speech synthesis apparatus which generates synthesized speech corresponding to a desired text and outputs the synthesized speech has been provided. As an application field, there is a use of enabling a user to listen to synthesized speech corresponding to the contents of e-mail instead of reading the e-mail itself which is written in text format.

However, a text of e-mail includes symbols such as citation symbols in the citation section and the signature section unlike texts of a novel and a newspaper article, and such symbols cannot be read out in a usual manner. Therefore, there is a need to modify these symbols appropriately so as to make them readable. Patent References 1 and 2 are example techniques for this purpose.

Patent Reference 1: Japanese Patent Publication No. 9-179719 (pages 7 to 8 of the description).

Patent Reference 2: Japanese Patent Publication No. 2003-85099 (pages 22 to 24 of the description).

The method of Patent Reference 1 makes it possible to circumvent the difficulty in reading out the citation text by, for example, eliminating a citation symbol which does not need to be read out and reading out only the citation text, or eliminating the whole citation section.

In addition, the method of Patent Reference 2 makes it possible to process the citation section in a more appropriate manner, more specifically, to collate a citation text with the character strings included in the accumulated texts of already-read e-mail and delete the citation section only in the case where the citation text is included in the texts of already-read e-mail.

SUMMARY OF THE INVENTION

Texts of e-mail are often cited on a line-by-line basis. Therefore, it is often that a citation sentence starts with the character which corresponds to the character placed in the middle of a sentence in the citation source e-mail, and that a citation sentence ends with the character which corresponds to the character placed in the middle of a sentence in the citation source e-mail. FIG. 22 shows an example of citation like this.

In FIG. 22, e-mail texts 800 to 802 represent a series of e-mail exchanged between two persons. A reply mail text 801 is written by citing a middle part-of-sentence "DONOYO NA SHIRYO WO YOI SUREBA (which kind of document should I prepare)" from the first mail text 800. In addition, a re-replay mail text 802 is written by citing 3rd, 7th, 8th and 11th lines when counted from the starting line of the reply mail text 801. The respective citation parts-of-text are not complete sentences because they have been simply cited from the citation source mail on a line-by-line basis. It is often that citation texts created in a manner like this include sentences which lack the starting parts or ending parts of the original sentences.

However, the conventional techniques described above have been conceived without considering reading out incomplete sentences like this. Therefore, there is a problem that such incomplete sentences which are read out as if they were complete sentences confuse users.

Another problem is that such incomplete sentences fail the linguistic analysis processing, resulting in adding unnatural rhythm to the incomplete sentences and deteriorating the quality of the synthesized speech.

On the other hand, it can be said that all of the characters in the incomplete parts like this which are the starting parts or ending parts of the sentences are not necessarily be read out in an audible manner. This is because it is considered that the incomplete parts are meaningless and thus not so important inherently in the reading-out.

Therefore, the present invention has been conceived considering these problems and circumstances. An object of the present invention is to provide a speech synthesis apparatus which can (a) prevent user confusion or deterioration of speech quality resulting from the incompleteness of the read-out sentences and (b) read out speech which can be easily understood by the user.

In order to solve the above-described object, the speech synthesis apparatus of the present invention generates synthesized speech corresponding to inputted text information. The apparatus includes: an incomplete part-of-sentence detection unit which detects from among the text information a part-of-sentence which is linguistically incomplete because of a missing character string in the part-of-sentence; a complementation unit which complements the detected incomplete part-of-sentence with a complement character string; and a speech synthesis unit which generates the synthesized speech based on the text information complemented by the complementation unit.

In this way, even in the case of a linguistically incomplete sentence some of whose constituent character strings have some missing characters, the sentence is complemented with some complement characters so as to generate synthesized speech, and thus the synthesized speech is to be provided with natural rhythm. Therefore, it becomes possible to prevent user confusion or deterioration of the quality of the synthesized speech.

Here, the speech synthesis apparatus further includes an acoustic effect addition unit which adds a predetermined acoustic effect to the synthesized speech corresponding to the incomplete parts-of-sentences which have been detected by the incomplete part-of-sentence detection unit. The acoustic effect addition unit includes an incomplete part-of-sentence obscuring unit which reduces the clarity degree of the synthesized speech corresponding to the incomplete parts-of-sentences which have been detected by the incomplete part-of-sentence detection unit.

With this structure, the read-out speech corresponding to the linguistically incomplete parts-of-sentences are obscured. Therefore, it becomes possible to realize a speech synthesis apparatus which enables a user to easily recognize the parts-of-sentences which are not so important in the reading-out.

Note that the present invention may be realized not only as a speech synthesis apparatus like this, but also as a speech synthesis method including steps which respectively correspond to the unique units included by the speech synthesis apparatus like this and as a program causing a computer such as a personal computer to realize these steps. As a matter of course, the program like this can be distributed by means of a recording medium such as a CD-ROM and a communication medium represented by the Internet.

As described up to this point, for a sentence which is linguistically incomplete because some of the constituent character strings have some missing characters, the speech synthesis apparatus of the present invention complements the sentence with complement characters so as to prevent the speech synthesis processing from failing or obscures the parts of sentence which are incomplete because of its missing characters and thus which cannot be synthesized successfully in the playback. Therefore, it becomes possible to present such read-out speech that can be easily understood by a user.

Further, in the case where the parts-of-sentences which are not so important in reading out the speech, in other words, the starting part of the first sentence or the ending part of the last sentence are incomplete, the speech synthesis apparatus reduces the clarity degree of the speech corresponding to the incomplete parts-of-sentences at the time of outputting the speech to be read-out. Therefore, the speech synthesis apparatus can notify a user that these parts-of-sentences are relatively meaningless, and thus it can prevent the user from being distracted by the strange rhythm and incomplete words in the read-out speech, and further present the information indicating that there were some meaningless characters at the corresponding positions in the synthesized speech without deleting the information.

FURTHER INFORMATION ABOUT TECHNICAL BACKGROUND TO THIS APPLICATION

The disclosure of Japanese Patent Application No. 2004-212649 filed on Jul. 21, 2004 including specification, drawings and claims is incorporated herein by reference in its entirety.

BRIEF DESCRIPTION OF THE DRAWINGS

These and other objects, advantages and features of the invention will become apparent from the following description thereof taken in conjunction with the accompanying drawings that illustrate a specific embodiment of the invention. In the Drawings:

FIG. 22 is a diagram indicating example texts which are targets of the present invention and have been described in the section of SUMMARY OF THE INVENTION in the present application.

DESCRIPTION OF THE PREFERRED EMBODIMENT(S)

Embodiments of the present invention will be described in detail with reference to figures.

First Embodiment

Figure 1:
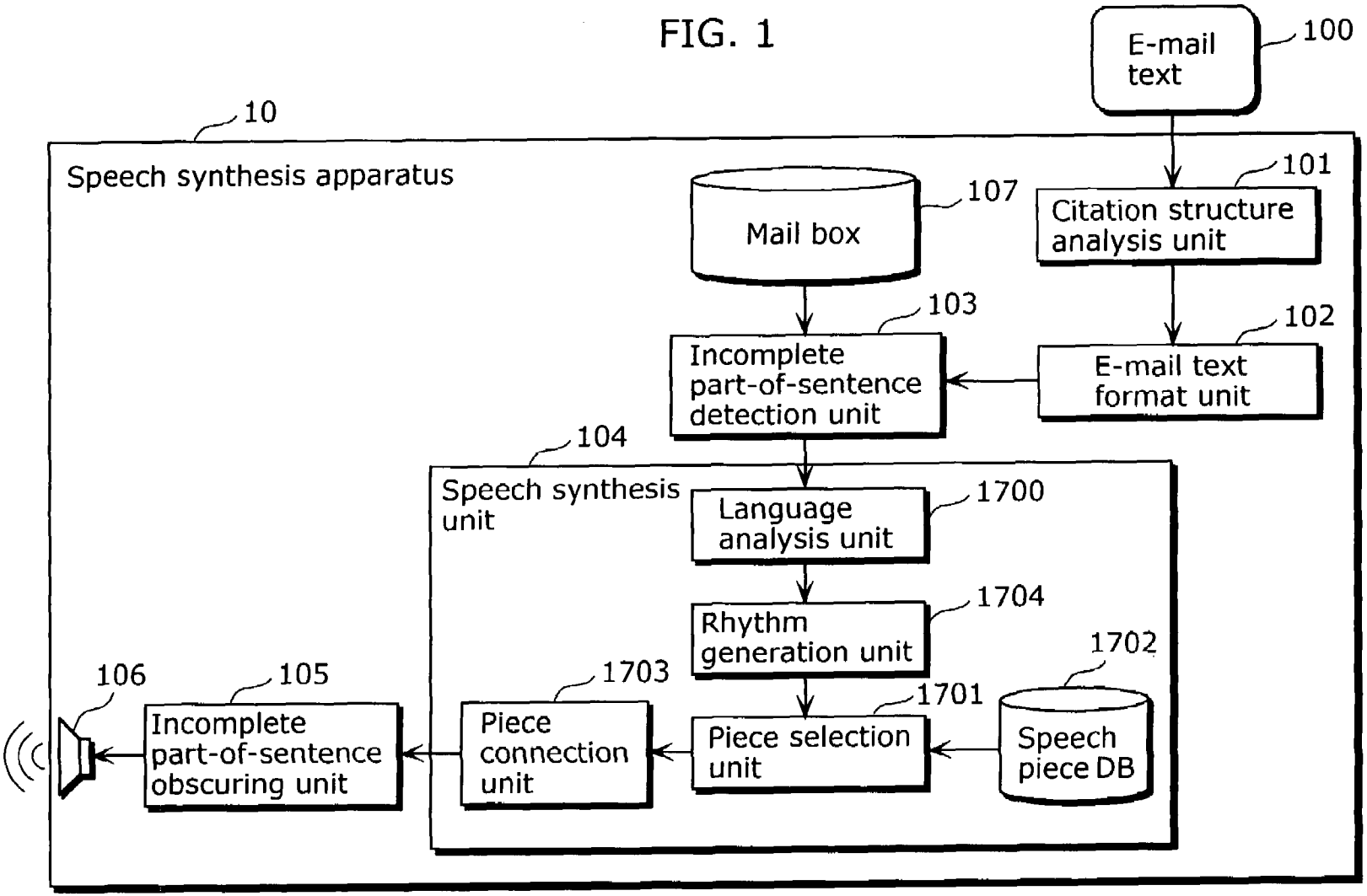
FIG. 1 is a block diagram showing the functional configuration of a speech synthesis apparatus of a first embodiment.

FIG. 1 is a block diagram indicating the functional configuration of a speech synthesis apparatus of a first embodiment of the present invention.

The speech synthesis apparatus 10 of the first embodiment obtains texts which are the contents communicated through e-mail, generates synthesized speech corresponding to the text, and outputs the generated synthesized speech. The speech synthesis apparatus 10 naturally reads out incomplete sentences which appear in the citation part included in the text of e-mail. The greatest feature of this speech synthesis apparatus 10 is to provide synthesized speech which sounds more natural to a user compared with synthesized speech whose clarity degree has not been reduced by outputting synthesized speech with a reduced clarity degree corresponding to the incomplete parts in the text.

As shown in FIG. 1, the speech synthesis apparatus 10 includes: a citation structure analysis unit 101 which analyzes the structure of the citation part of the e-mail text 100 to be inputted; an e-mail text format unit 102 which formats the e-mail text on a sentence-by-sentence basis taking into account the structure of the analyzed citation part; a mail box 107 which has a storage area for accumulating the e-mail texts which were sent and received in the past; an incomplete part-of-sentence detection unit 103 which detects incomplete sentences included in the e-mail text 100 with reference to the e-mail text, which were sent and received in the past, included in the mail box 107, and identifies the incomplete parts; a speech synthesis unit 104 which receives the text as an input and outputs the synthesized speech; an incomplete part obscuring unit 105 which performs processing for acoustically obscuring only the incomplete parts detected by the incomplete part-of-sentence detection unit 103 in the synthesized speech to be outputted by the speech synthesis unit 104; and a speaker device which plays back and outputs the generated synthesized speech.

Here, the speech synthesis unit 104 can be further divided into functional sub-blocks. The speech synthesis unit 104 includes: a language processing unit 1700 which receives the text as an input and outputs the language analysis result of the text; a rhythm generation unit 1704 which generates rhythm information based on the language analysis result of the text; a speech piece database (DB) 1702 which stores speech pieces; a piece selection unit 1701 which selects appropriate speech pieces from among the speech pieces included in the speech piece DB 1702; a piece connection unit 1703 which modifies the speech pieces selected by the piece selection unit 1701 so that they can match a previously generated rhythm, connects them with each other smoothly by further modifying them, and outputs the synthesized speech data corresponding to the inputted text.

The citation structure analysis unit 101 analyzes the e-mail text 100 in a simple manner and formats the text according to a citation depth, a paragraph change and the like.

Here, a citation depth means the number of citation of each sentence. More specifically, the citation structure analysis unit 101 identifies the citation depth of each sentence depending on the number of citation symbols which are serial starting with the first citation symbol in the starting part of a line.

In addition, a paragraph change means the part where the groups of sentences related to each other in meaning is changed. The citation structure analysis unit 101 identifies the paragraph change based on the part where a blank line is present or a line with a different indent amount is present in the text with the same citation depth. Note that the citation structure analysis unit 101 may identify the paragraph change based on (a) a character string such as "(CHURYAKU) (omitted in the middle)" and "(RYAKU)(omitted)" which implies that there is an omission in the middle of a text or (b) a line, which is made up of only "(:)" molded from "( . . . )" represented in the vertical direction, which implies a paragraph change as well as a blank line and a different indent amount.

The e-mail text format unit 102 formats the e-mail text 100 by dividing it on a sentence-by-sentence basis based on the result of analysis performed by the citation structure analysis unit 101. This e-mail text format unit 102 further summarizes the mail header and the signature.

Figure 2:
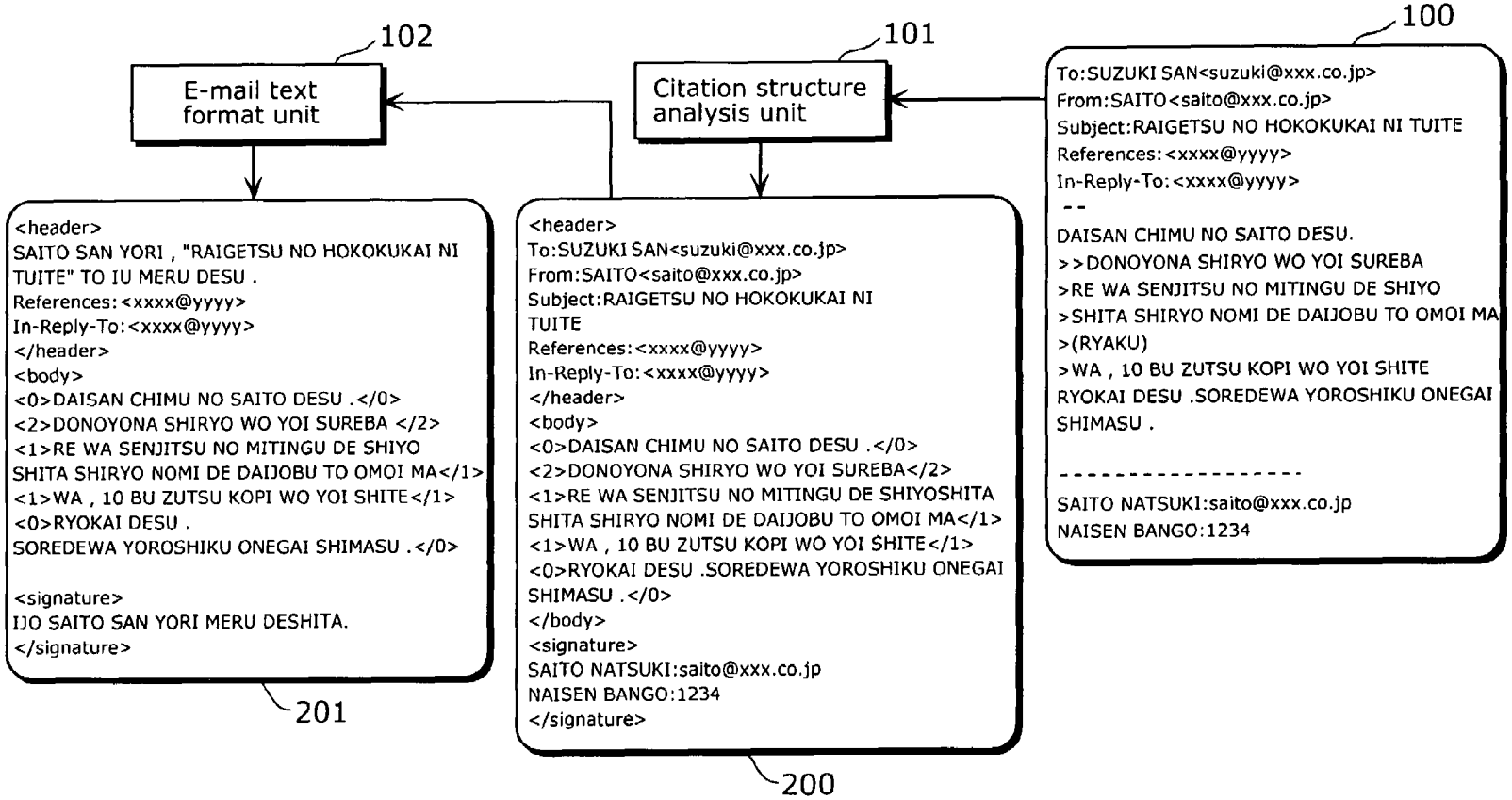
FIG. 2 is a diagram for illustrating the operations of a citation structure analysis unit and an e-mail text format unit.

FIG. 2 is a diagram for illustrating the operations performed by the citation structure analysis unit 101 and the e-mail text format unit 102.

In FIG. 2, the citation structure analysis unit 101 analyzes the e-mail text 100 as shown below, and adds a tag indicating the analysis result to the e-mail text 100 so as to generate a text 200 with an analyzed citation structure.

1) First, it identifies the first line to the line before "– – (two minus symbols)" in the e-mail text 100 as the header and encloses the identified part by the tags "<header>" and "</header>".

2) It searches for the signature section which is positioned after the end of the e-mail text 100, by searching for the first line which is made up of only two or more continuous symbolic-characters. In the case where the searched line is not the ending line of the header which has been identified in the above 1) and the number of lines from the searched line to the ending line of the e-mail text 100 is not more than 10, it identifies the part starting with the searched line and ending with the ending line as the signature section and encloses the section by the tags "<signature>" and "</signature>".

3) It identifies a part of the e-mail text positioned between the header section and the signature section as the body of the e-mail and encloses the part by the tags "<body>" and "</body>".

4) It repeats the following processes shown in the following 5) to 10) until the e-mail body enclosed by the tags "<body>" and "</body>" is processed thoroughly from the starting line to the ending line.

5) It counts the number of citation symbols positioned in the starting part of the current line, and replaces the citation symbols by the tag indicating the number of citation symbols. Here are examples. In the case where there is one citation symbol, it assigns "<1>" instead of leaving the citation symbol. In the case where there are two citation symbols, it assigns "<2>" instead of leaving these citation symbols. In the case where there is no citation symbols (which means that there is no citation), it assigns "<0>". Note that, it does not close the tag at this time. Hereinafter, the tag indicating the number of citation symbols is described as "citation tag", and the number of citation symbols is described as "citation level".

6) In the case where the current line is the ending line of the e-mail text or the following lines correspond to the signature section, it closes the citation tag in order to complete the citation. For example, in the case where the current line is not the citation part, it adds "</0>" to the end of the line so as to complete this algorithm.

7) It starts to read the next line.

8) In the case where: the number of citation symbols varies between the current line and the line immediately before the current line; the current line is a blank line; the current line is a character string such as "(CYURYAKU) (omitted in the middle)" and ":" which indicates the omission of one or more original sentences; or the number of indents varies between the current line and the immediately before line, it moves to the following 10).

9) It deletes the citation symbol at the starting part of a line, and moves to the above 6).

10) It closes the citation tag after the immediately before line, and moves to the above 5).

According to the above procedures 1) to 10), the text 200 with an analyzed citation structure is generated, and the text 200 has the following features.

(a) In the section enclosed by the tags "<header>" and "</header>" the header section of the original e-mail text 100 is contained.

(b) In the section enclosed by the tags "<signature>" and "</signature>" the signature section of the original e-mail text 100 is contained.

(c) In the section enclosed by the tags "<body>" and "</body>" the body section of the original e-mail text 100 is contained.

(d) Each paragraph in the body section is enclosed by citation tags. Additionally, these tags indicate a citation depth.

Further, in FIG. 2, the e-mail text format unit 102 processes the text 200 with an analyzed citation structure as will be described below, and generates a formatted text 201.

1) It summarizes the section enclosed by the tags <header> and </header> so as to make the sentences easily readable. For example, it extracts only the From field representing the sender of the mail and the Subject field representing the title, and then converts the contents into a sentence "○○ SAN YORI, xx TO IU MERU DESU. (incoming mail saying "xx", from Mr./Ms. ○○.)". At this stage, it is desirable that the contents in the In-Reply-To field and the References field which represent the thread structure of the e-mail be held instead of being deleted in preparation for the following processing in the incomplete part-of-sentence detection unit 103.

2) It summarizes the section enclosed by the tags <signature> and </signature> so as to make the sentences easily readable. Otherwise, it just deletes the section.

3) It deletes line feed characters and blanks from the sentences, which are enclosed by the respective citation tags, in the section enclosed by the tags <body> and </body> so as to make the contents into a single-line-text, and divides the single-line-text into sentences using punctuations.

The incomplete part-of-sentence detection unit 103 receives the formatted text 201 generated by the e-mail text format unit 102. The incomplete part-of-sentence detection unit 103 collates the received formatted text 201 with the e-mail texts which were sent and received in the past and accumulated in the mail box 107 so as to find the first e-mail which includes the first sentence or the last sentence indicating a citation level of 1 or more inside a pair of citation tags. After that the incomplete part-of-sentence detection unit 103 determines whether each citation sentence is complete, in other words, whether no character strings of the original sentences are missing, based on a character string matching. Further, in the case where the citation sentence is incomplete, the incomplete part-of-sentence detection unit 103 replaces the incomplete sentence by the complete original sentence and then makes the part cited from the complete original sentence identifiable.

Figure 3:
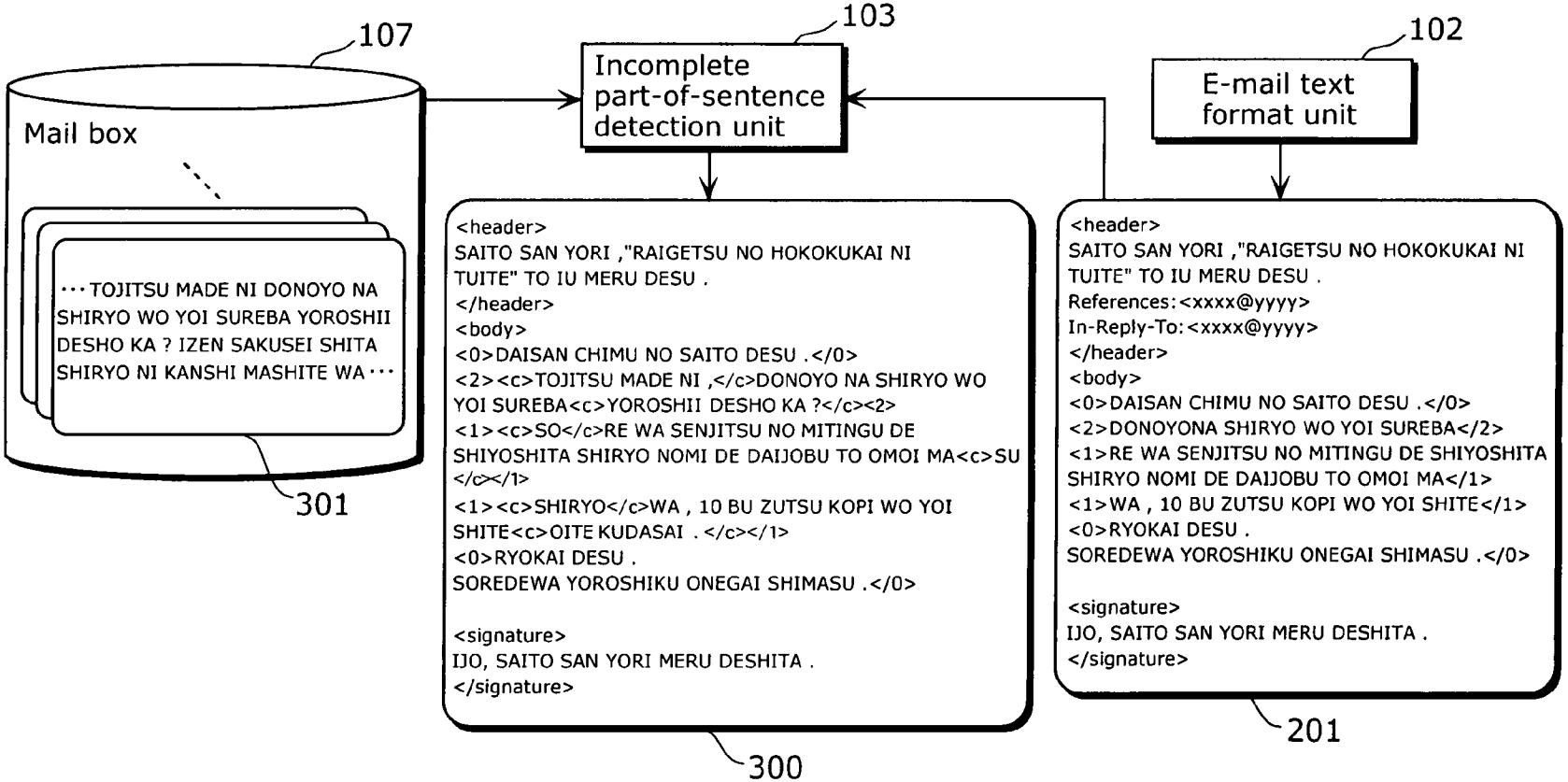
FIG. 3 is a diagram for illustrating the outline of the processing performed by an incomplete part-of-sentence detection unit.

FIG. 3 is a diagram for illustrating the outline of the processing performed by the incomplete part-of-sentence detection unit 103. In FIG. 3, the incomplete part-of-sentence detection unit 103 performs the processing which will be described below.

1) It obtains all of the past e-mail text 301 in the mail box 107 whose message IDs match the message IDs written in the In-Reply-To field and the References field with reference to the message IDs written in the In-Reply-To field and the References field. Further, it recursively obtains all the past e-mail text 301 in the same thread with reference to the In-Reply-To field and the References field of the e-mail text 301.

2) Eliminating all of the header section, the signature section, the citation section from the obtained past e-mail text 301. Further eliminating line feed characters and blanks from the body section in preparation for a character string matching.

3) It searches the e-mail text 301 where the first sentence or the last sentence indicating a citation level of 0 enclosed by a pair of citation tags inside the body part appears by means of a character string matching.

4) In the case where the matching character string identified in the above 3) is a part of a sentence, it replaces the incomplete sentence of the formatted text 201 by the original complete sentence included in the past e-mail text 301. Further it differentiates the part which is not included in the formatted text 201, in other words, the part complemented from the past e-mail text 301 by enclosing the part using the tags <c> and </c>.

5) It repeats the Processes 3) and 4) on all the citation tags in the body section.

6) It deletes the In-Reply-To field and the References field from the header section.

According to the Processes 1 to 5 described above the text 300 with detected incomplete parts-of-sentences is generated, and the text 300 has the following features.

(a) In the section enclosed by the tags "<header>" and "</header>" the header section of the original e-mail text 100 is contained after being summarized.

(b) In the section enclosed by the tags "<signature>" and "</signature>" the signature section of the original e-mail text 100 is contained after being summarized.

(c) In the section enclosed by the tags "<body>" and "</body>" the body section of the original e-mail text 100 is contained.

(d) Each paragraph in the body section is enclosed by citation tags, and each of these tags indicates a citation depth.

(e) All of the sentences in the body section are complete sentences without any missing character string because of citation. In the case where a citation sentence included in the original e-mail text 100 is an incomplete sentence, only the part complemented from the e-mail which were sent and received in the past is enclosed by the tags <c> and </c> so as to be differentiated.

The speech synthesis unit 104 processes the text 300 with detected incomplete parts-of-sentences which have been generated in this way on a sentence-by-sentence basis starting with the first sentence, generates synthesized speech and outputs the generated synthesized speech. In the case where there is a sentence including a part enclosed by the tags <c> and </c> at this time, the speech synthesis unit 104 outputs the synthesized speech in a form that the part enclosed by the tags <c> and </c> is identifiable.

The following processing is performed inside the speech synthesis unit 104.

Figure 4:
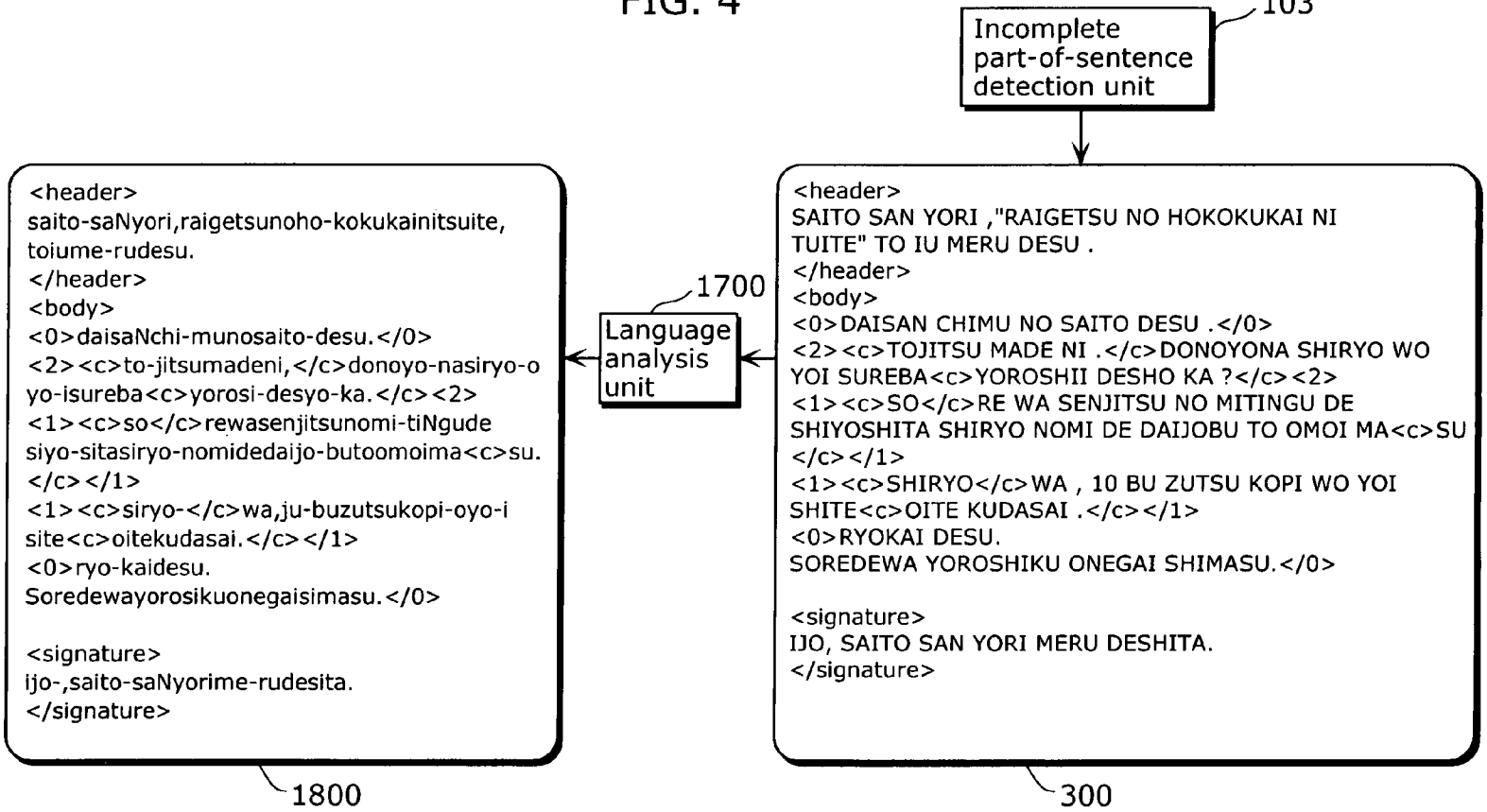
FIG. 4 is a diagram for illustrating an example operation performed by a language analysis unit.

First, as shown in FIG. 4, the language processing unit 1700 processes the text 300 with detected parts-of-sentences which has been generated by the incomplete part-of-sentence detection unit so as to generate phoneme transcription text 1800. This phoneme transcription text 1800 is obtained by converting the Japanese sentences including the Kanji characters of the text 300 with detected parts-of-sentences into phoneme transcriptions. It is possible to improve the quality of the synthesis speech by adding, to the synthesized speech, accent information and syntax information which are obtained as a result of a language analysis. However, FIG. 4 shows phoneme transcriptions only, for simplification.

Figure 5:
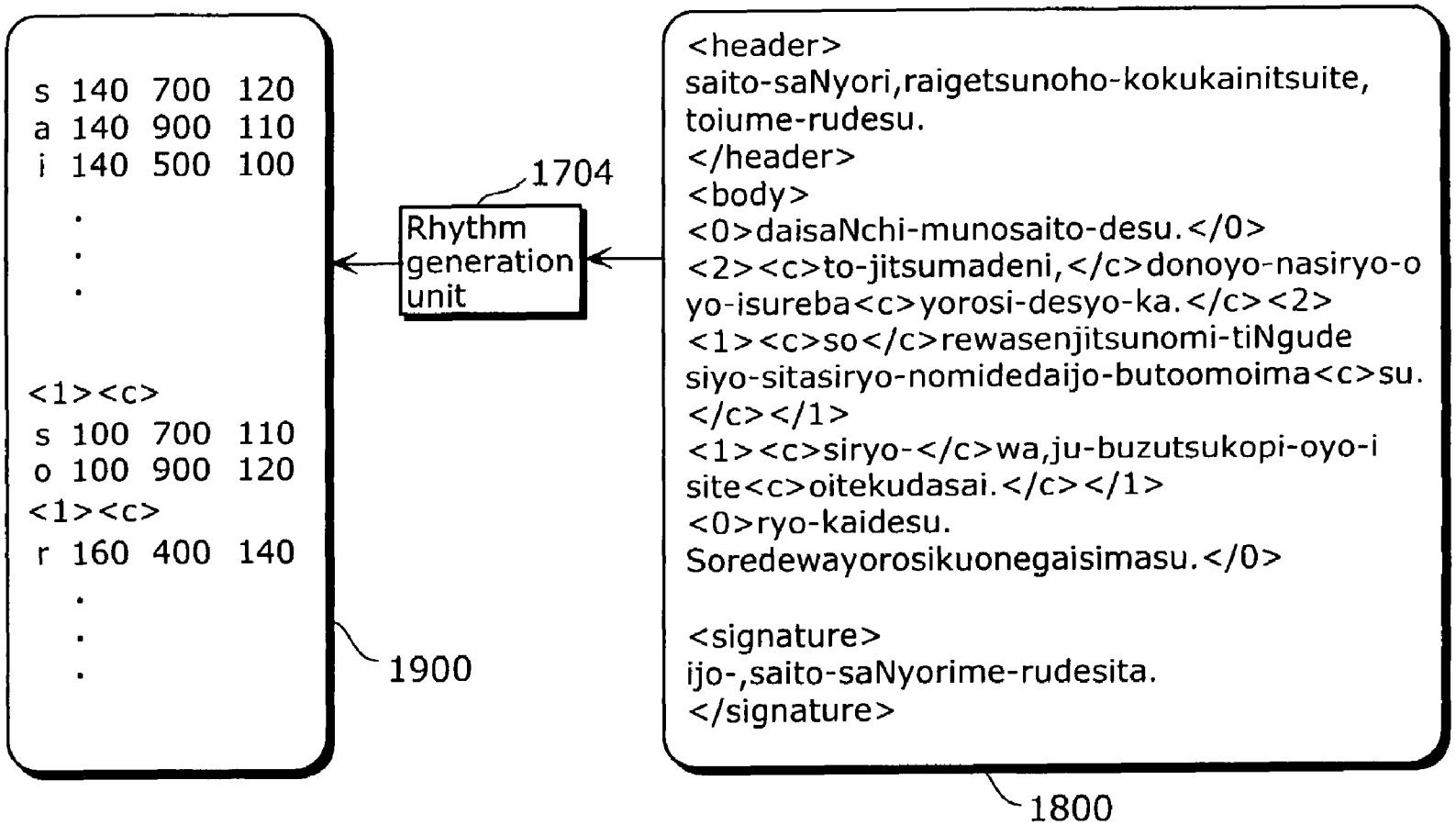
FIG. 5 is a diagram for illustrating an example operation performed by a rhythm generation unit.

Next, as shown in FIG. 5, the rhythm generation unit 1704 calculates the duration time of each phoneme, the basic frequency at the time center and the power value based on the generated phoneme transcription text 1800, and outputs the phoneme transcription text 1900 with rhythm to the speech piece selection unit 1701. Like the case of FIG. 4, syntax information and the like which are obtained as a result of a language analysis are omitted for simplification in the illustrations of the phoneme transcription text 1800 and the phoneme transcription text 1900 with rhythm also in FIG. 5. However, in reality, it is desirable that these data to the synthesized speech be added because the addition of these data enables the piece selection unit 1701 to perform speech piece selection processing with a higher accuracy.

Figure 6:
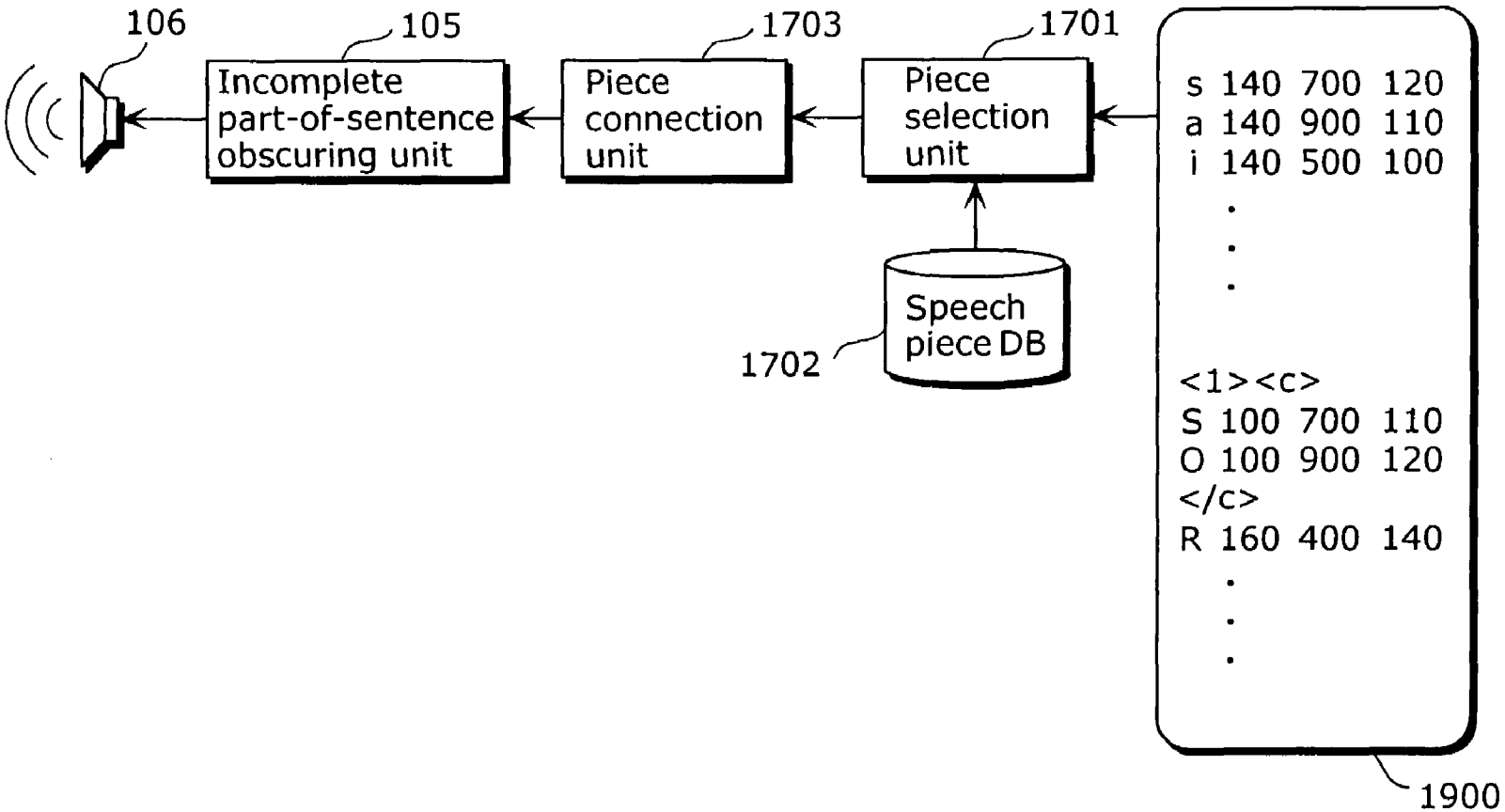
FIG. 6 is a diagram for illustrating example operations performed by a piece selection unit, a piece connection unit and an incomplete part-of-sentence obscuring unit.

Next, as shown in FIG. 6, the piece selection unit 1701 obtains the optimum speech piece data from the speech piece DB 1702 based on the information of the phoneme transcription text 1900 with rhythm which has been obtained by the rhythm generation unit 1704. As a typical structure, the speech piece DB 1702 stores, as each speech piece, speech waveform data which has been divided on a phoneme-by-phoneme basis. The previously analyzed duration time, basic frequency and power value of each speech piece, and the syntax information and the like in each sentence used at the time of recording each speech piece is added to the speech piece. The piece selection unit 1701 selects the speech piece which is closest to the output contents by the language processing unit 1700 and the rhythm generation unit 1704 based on the information.

The piece connection unit 1703 receives the speech pieces which are outputted from the piece selection unit 1701 in the output order, modifying the speech pieces so that they have a previously calculated rhythm by transforming the duration time of each speech piece, the basic frequency, and the power value, and further transforming the modified speech pieces so that they are smoothly connected with each other, and outputs the resulting synthesized speech to the incomplete part-of-speech obscuring unit 105 as a result of the processing performed by the speech synthesis unit 104.

Figure 7:
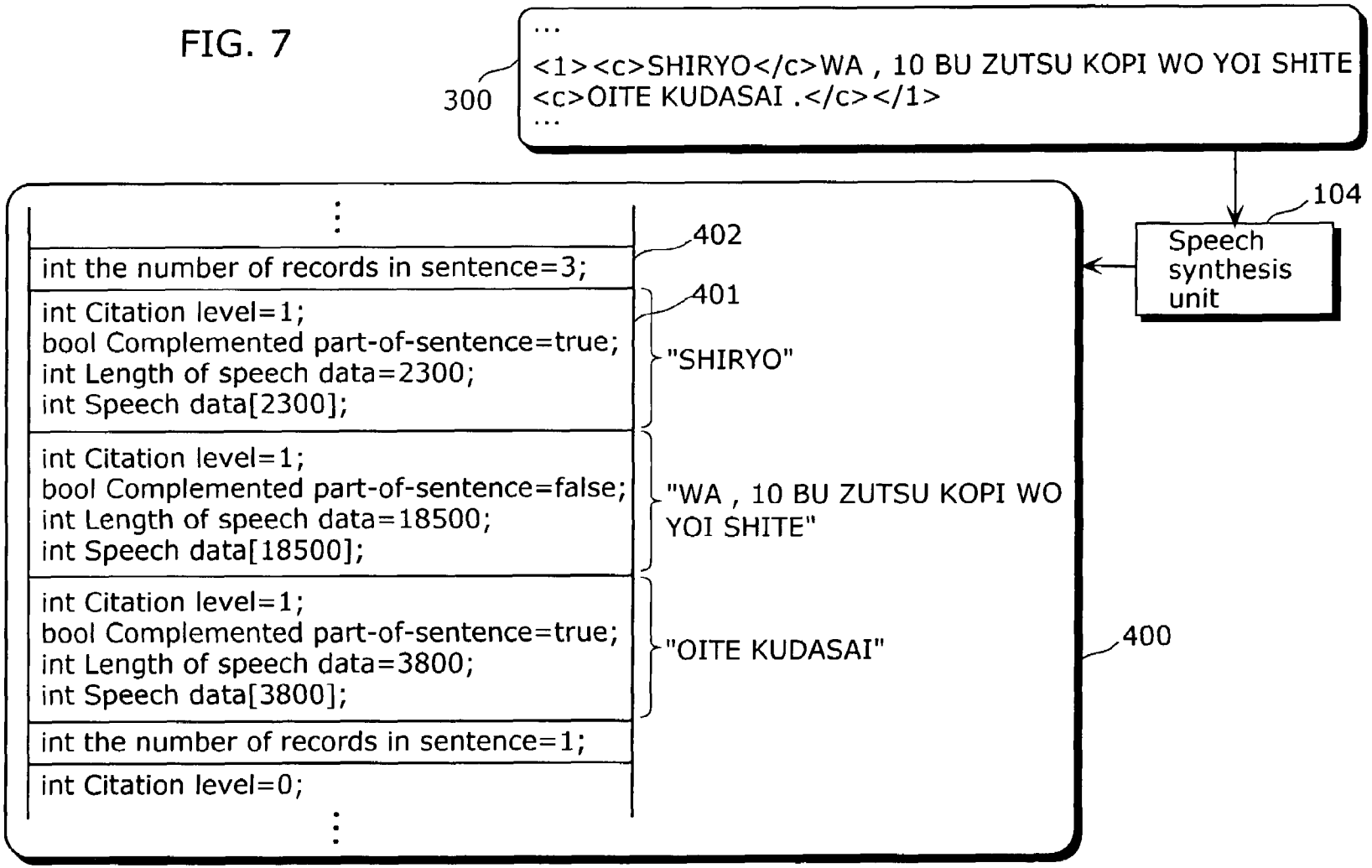
FIG. 7 is a schematic diagram of synthesized record strings.

FIG. 7 is a diagram for illustrating an example synthesized speech record string 400 which is generated by the speech synthesis unit 104 based on the text 300 with detected incomplete parts-of-sentences.

The speech synthesis unit 104 performs speech synthesis after removing all the tags included in the respective sentences of the text 300 with incomplete parts-of-sentences, divides the generated synthesized data at the tag <c>, and outputs the divided synthesized data in the list of record 401. Each record 401 has a structural format of the following array of recodes. Each record 401 includes: an int value (citation level) indicating a citation level; a bool value (complemented part) indicating whether the speech data of the record corresponds to the character strings enclosed by the tags <c> and </c>; an int value (speech data) indicating the data length of the synthesized speech included in the record; and an int value (speech data) which is the body of the synthesized data included in the record. A record header 402 which has the int value (the number of records in a sentence) indicating the number of records which constitute the following sentences is in the leading part of the list of records 401.

Here, the speech synthesis unit 104 may process the respective header section, body section, and signature section using different voice tones.

In addition, it is possible to change the voice tones depending on the citation level of each sentence included in the body section. Provided that the sentences with an even-number citation level is processed so as to become synthesized speech with voice tone A, and that the sentences with an odd-number citation level is processed so as to become synthesized speech with voice tone B. This makes the speaker of each sentence easily identifiable. Provided further that the contents of the From field indicating a sender is embedded in the citation tag, and that voice tones of the synthesized speech are changed depending on the sender embedded in the citation tag. This makes the read-out synthesized speech further understandable.

Consequently, the incomplete part-of-sentence obscuring unit 105 receives the synthesized record string 400 structured as described above, and performs the following processing.

1) It reads the record header 402, and obtains the number of records in a sentence.

2) It repeats the following 3) to 5) according to the number of records in a sentence which has been obtained in the above 1).

3) It reads one of the records. In the case where this record is not the part complemented by the incomplete parts-of-sentences detection unit 103, it outputs the speech data of this record as it is, and repeats this 3). In contrast, in the case where this record is the complemented part, it moves to the following 4).

4) In the case where this record is the first record in the sentence and the length of the speech data is not shorter than 2 seconds, it reduces the speech data into the last 2 seconds of the speech data. Further, it transforms the reduced speech data so that the speech data fades in from 0 percent at the start to 100 percent at the end. In contrast, in the case where this record is the last record in the sentence, it reduces the speech data into the first 2 seconds of the speech data. It transforms the speech data reduced in the same manner so that it fades out from 100 percent at the start to 0 percent at the end.

5) It outputs the transformed speech data, and moves to the above 3).

According to the above described Procedures 1) to 5), the speech data is outputted by the incomplete part-of-sentence obscuring unit 105, and the speech data has the following features.

(a) All the sentences included in the formatted text 201 are included in a form of speech.

(b) Using the parts added by the incomplete part-of-sentence detection unit 103 to the formatted text 201, the missing part at the starting part of the incomplete text in the formatted text 201 is played back with a fade-in of 2 seconds at most, and the missing part at the ending part is played back with a fade-out of 2 seconds at most. After that, the next sentence is played back.

As described above, with the speech synthesis apparatus 10 of the first embodiment, the following processing is performed. The structure of the e-mail text 100 is analyzed by the citation structure analysis unit 101. Based on the result a formatted text 201 which is suitable for being read out is generated by the e-mail text format unit 102. Further, the incomplete parts are detected and complemented by the incomplete part-of-sentence detection unit 103. As the result, it becomes possible for the speech synthesis unit 104 to perform speech synthesis processing on the sentence which becomes as complete as the original sentence through complementation. Therefore, it is possible to prevent unnatural rhythm from confusing a user who is a listener. In addition, to cause the incomplete part-of-sentence obscuring unit 105 perform fade-in and fade-out processing on the complemented part of the speech makes it possible to read out all the parts which have been cited in the e-mail text 100 and acoustically present the presence of the parts which have been deleted through citation to a user.

Note that, in the case where the synthesized speech record string 400 completely includes at least the speech of the part which is not enclosed by the tags <c> and </c> and also includes the speech of the part enclosed by the tags <c> and </c>, it is possible to perform the processing equivalent to this as long as an incomplete part-of-sentence pointer information indicating the position of an incomplete part-of-sentence is included in the synthesized speech record string 400.

In addition, in the case where the incomplete part-of-sentence detection unit 103 can perform a further higher language analysis and detects that the morpheme and the phrase positioned at the starting part and the ending part of the citation sentence are incomplete, it is possible to complement the sentence with the complement characters for making the incomplete morpheme and phrase into a complete morpheme and a complete phrase so as to perform speech synthesis, and obscure the speech of the parts including the morpheme and phrase by means of fade-in, fade-out and the like.

In addition, it is possible to obscure only speech of the incomplete morpheme and phrase without complementing the incomplete morpheme and phrase in order to make the most of the greatest feature of the present invention independently. The greatest feature is to output synthesized speech with a reduced clarity which corresponds to the incomplete part of the text. Here, in the case of the first sentence in a citation part, the incomplete part-of-sentence detection unit 103 may perform a morpheme analysis of the first sentence from right to left and then regard an unknown word which appeared in the starting part of the first sentence as an incomplete part. In contrast, in the case of the last sentence in the citation part, the incomplete part-of-sentence detection unit 103 may perform a morpheme analysis of the last sentence from left to right and then regard an unknown word which appeared in the ending part of the last sentence as an incomplete part.

Figure 8:
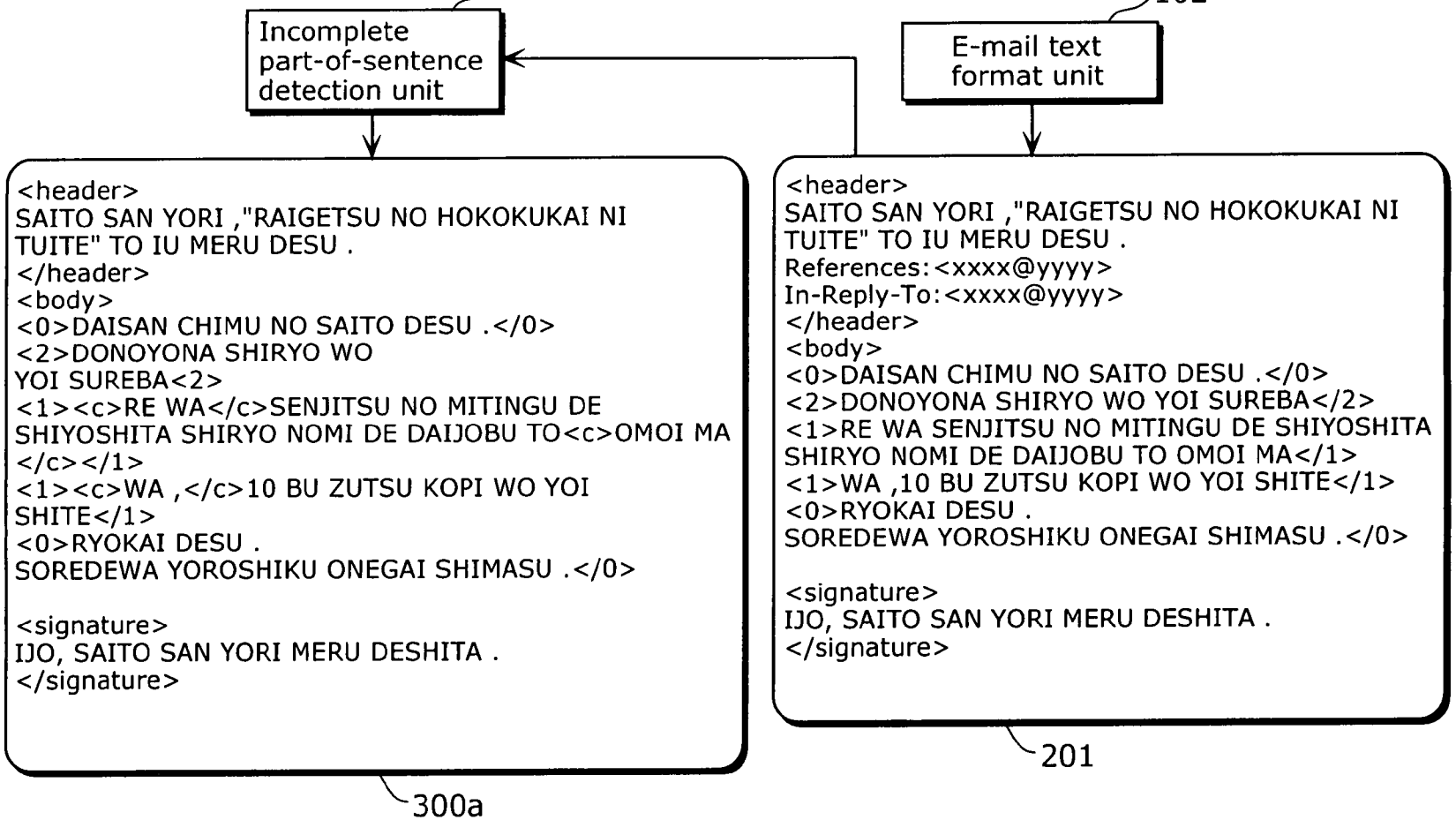
FIG. 8 is a diagram indicating examples of detection results obtained in the case where the incomplete part-of-sentence detection unit does not perform any complementation.

FIG. 8 shows an example result which can be obtained in the case where the incomplete part-of-sentence detection nit 103 performs only detection of the incomplete parts on a phrase-by-phrase basis without complementing the formatted text 201. The text 300*a* with detected incomplete parts-of-sentences has the following features in contrast to the text 300 with detected incomplete parts-of-sentences (refer to FIG. 3).

(a) The incomplete parts in the starting part and the ending part of sentences are not complemented.

(b) The parts which are originally present in the starting part or the ending part of sentences and which are judged as incomplete phrases are enclosed by the tags <c> and </c> so as to be differentiated.

The structure like this for detecting such incomplete parts without complementation is particularly suitable for the case where the text to be used for complementing the incomplete parts cannot be obtained easily (The case includes of course the case where the citation source mail is not accumulated in the mail box 107, and for example the case of reading out the text which has been cut out from various citation sources, other than e-mail, such as Web pages electric books, electric program information and the like.)

The description provided up to this point is based on the situation where incomplete parts appear in the starting part and the ending part of the citation part in e-mail. However, it should be noted that incomplete parts may appear in a text even under the situation where a part of the text specified by a user is read out.

In order to handle such a situation, it is preferable that the speech synthesis apparatus 10 further includes a part specification receiving unit (not shown) which receives a specification of a part of a text, and that the incomplete part-of-sentence detection unit 103 detects at least one of the incomplete part in the starting part and the incomplete part in the ending part of the specified part. This part specification receiving unit may be realized using a cursor key and an input pen which are generally provided to an information terminal apparatus, and the specified part may be reversed, flickered or the like in display according to conventional and commonly used styles.

In addition, the incomplete part-of-sentence obscuring unit 105 may add the following sound effect to the complemented part instead of speech: the sound effect implying that the following speech starts with the middle part of the original sentence and the preceding speech ends with the middle part of the original sentence. Provided that the speech of the incomplete part in the starting part of a sentence is replaced by a radio tuning noise (that sounds like "kyui"), and the speech of the incomplete part in the ending part of a sentence is replaced by a white noise (that sounds like "za". The replacement makes it possible to create speech that sounds like "(kyui) WA, 10 BU ZUTSU KOPI WO YOI SHITE (prepare 10 copies) (za)".

Figure 9:
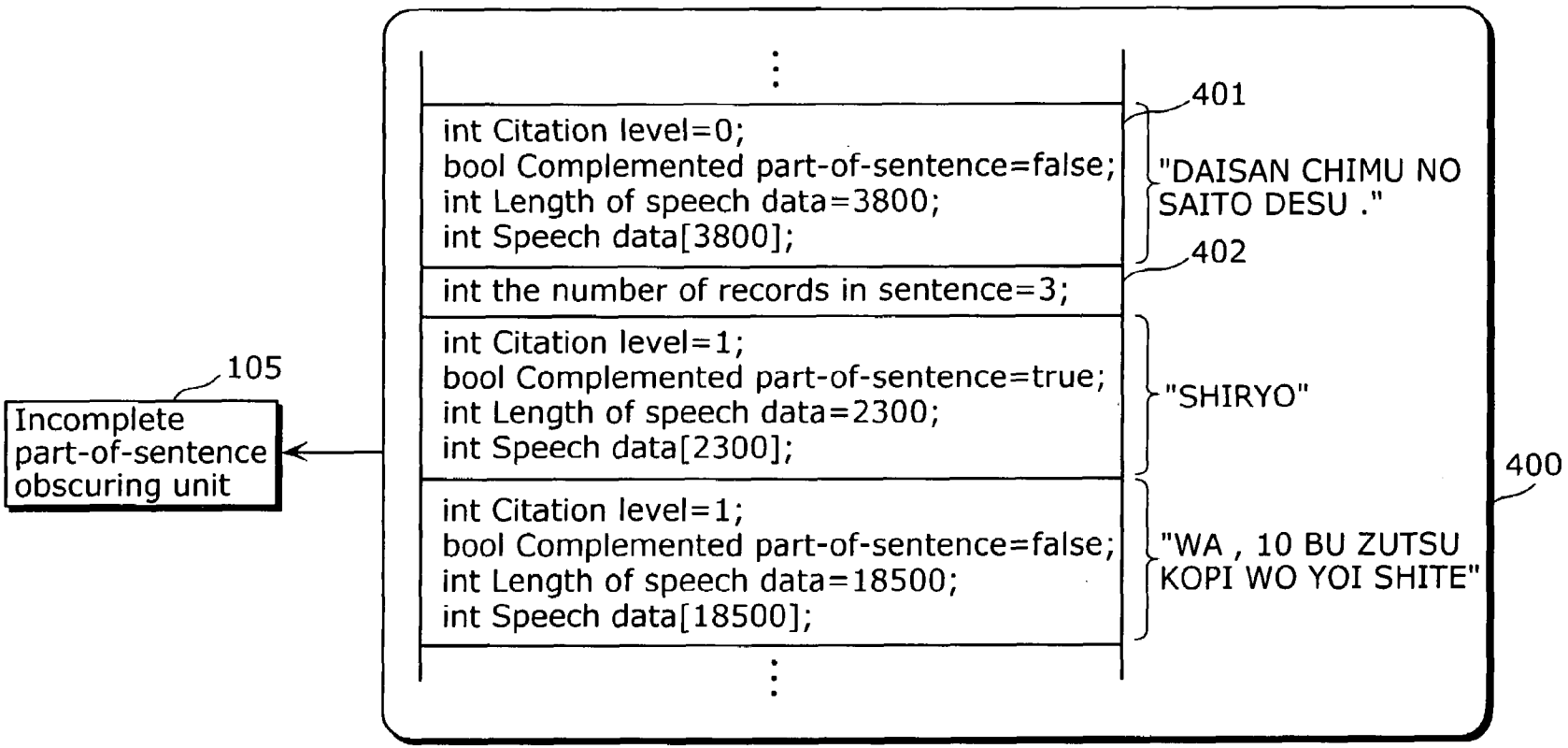
FIG. 9 is a diagram indicating examples of synthesized speech record strings to be inputted in the incomplete part-of-sentence obscuring unit.
Figure 10:
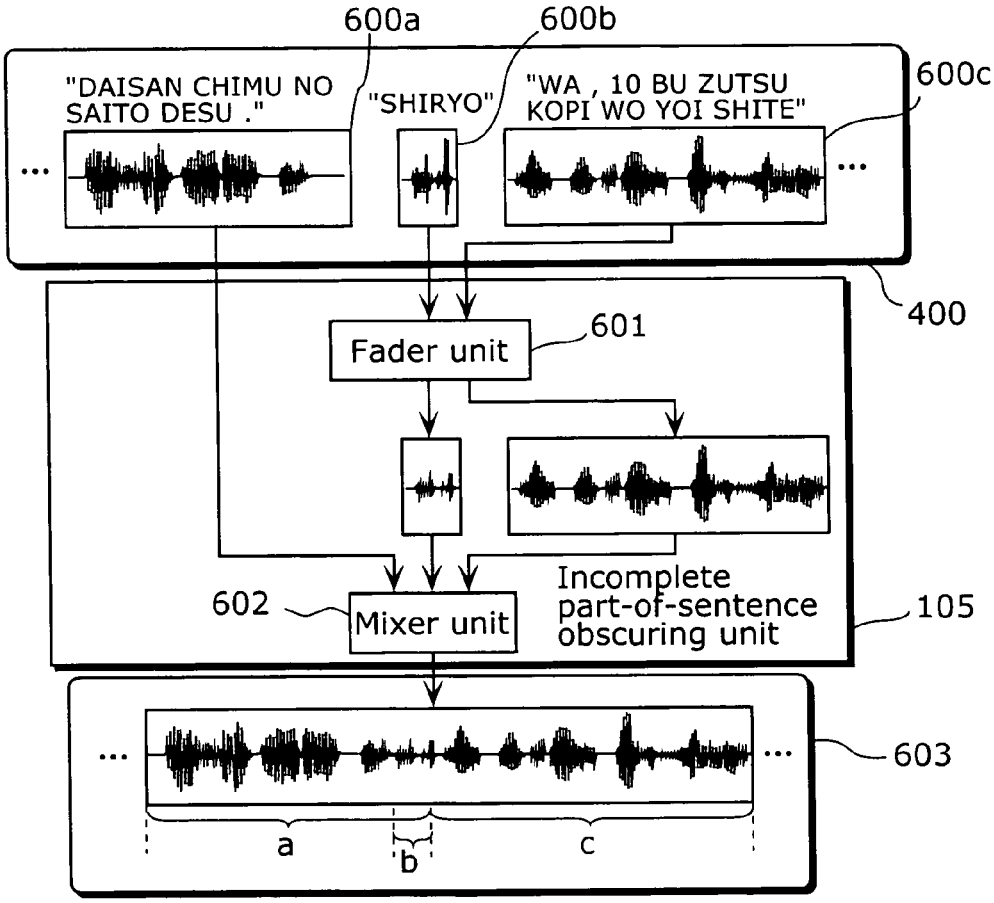
FIG. 10 is a schematic diagram indicating an example of fade-in processing performed by the incomplete part-of-sentence obscuring unit.

In addition, the incomplete part-of-sentence obscuring unit 105 may output speech in which the obscured incomplete parts are played back by being overlapped with the preceding sentence and the following sentence. The overlap is often performed in the case where citation is started with the middle part of speech of TV, radio, an interview or the like. Here is an example case where the synthesized speech record string 400 is provided to the incomplete part-of-sentence obscuring unit 105, as shown in FIG. 9. The processing performed by the incomplete part-of-sentence obscuring unit 105 will be described below with reference to FIG. 10.

1) It reduces the volume of the synthesized speech 600*b* of "SHIRYO (document)", which is the complemented part, down to 10 percent of the volume of the original speech using the fader unit 601 that the incomplete part-of-sentence obscuring unit 105 includes.

2) It performs a fade-in processing of the starting part in the synthesized speech 600*c* which follows the complemented part so that the volume of speech of the starting part changes, in a second, from 10 percent to 100 percent of the original volume of speech, also using the fader unit 601. The synthesized speech 600*c* is "WA, 10 BU ZUTSU KOPI WO YOI SHITE (prepare 10 copies)".

3) It performs the following mixing processing and connection processing so as to generate output speech 603 using the mixer unit 602 that the incomplete part-of-sentence obscuring unit 105 includes. In the mixing and connection processing, the synthesized speech 600*b* of "SHIRYO (document)", which is the complemented part, is overlapped with the ending part of the synthesized speech 600*a* of "DAI SAN CHIMU NO SAITO DESU (This is Saito in the third team)" which is the precedent sentence, and in sequence the synthesized speech 600*c* of "WA, 10 BU ZUTSU KOPI WO YOI SHITE (prepare 10 copies)" flows. This figure shows that: the processing result of the synthesized speech 600*a* is included in the segment of output speech 603; the processing result of the synthesized speech 600*b* is included in the segment b which is overlapped with the segment a; and the processing result of the synthesized speech 600*c* is included in the segment c which follows the segments a and b.

The use of the method described above makes it possible to read out citation sentences according to an approach which is intended for TV, radio or interview speech and is already familiar to a user.

Note that the incomplete part-of-sentence obscuring unit 105 may not only control the volume of speech to be inputted but also mix a noise at an appropriate rate. Here is an example in the processing provided above. White noise data with a predetermined volume is prepared. The white noise with a volume of 90 percent of the original volume is mixed with the synthesized speech 600*b*, and the white noise whose volume is fading out from 90 percent to 0 percent is mixed with the part corresponding to the first second of the synthesized speech 600*c*. The processing like this makes it possible to create the following speech. The synthesized speech 600*b* with a low volume and a high noise ratio starts to be mixed in the ending part of the synthesized speech 600. After the playback of the synthesized speech 600*a*, the volume of the following synthesized speech 600*c* becomes louder gradually and the ratio of mixed noise becomes lower gradually.

In addition, the incomplete part-of-sentence obscuring unit 105 may delete the speech of the detected incomplete part. The deletion of the incomplete part disables a user to understand that the sentence of the citation source is incompletely cited. However, this helps the user to understand the contents of the citation sentences because the user can listen to the linguistically complete parts exclusively.

In addition, in the case of deleting the incomplete parts, it is possible to cause the speech synthesis unit 104 to generate synthesized speech after causing the incomplete part-of-sentence detection unit 103 to delete the characters of the incomplete parts. If doing so, the rhythm of the speech changes because a sentence with a deleted missing part is regarded as a complete sentence in the generation of the speech, unlike the case of generating speech of the original complete sentence and deleting a part of the sentence. However, this provides the following merit. Since the result outputted by the speech synthesis unit 104 can be played back by the speaker device 106 as it is, the incomplete part-of-sentence obscuring unit 105 becomes unnecessary and thus the configuration of the speech synthesis apparatus can be simplified.

In addition, it is possible to eliminate the whole obscuring processing of the part of a sentence which becomes complete through the complementation of the incomplete part. In this case, the speech sounds lengthy to a user. However, there is a merit that the user can surely and always listen to complete sentences without any missing parts.

Second Embodiment

Next, a speech synthesis apparatus of a second embodiment of the present invention will be described.

The speech synthesis apparatus of the second embodiment includes variations of the speech synthesis unit 104 and the incomplete part-of-speech obscuring unit 105 in the speech synthesis apparatus 10 of the first embodiment.

Figure 11:
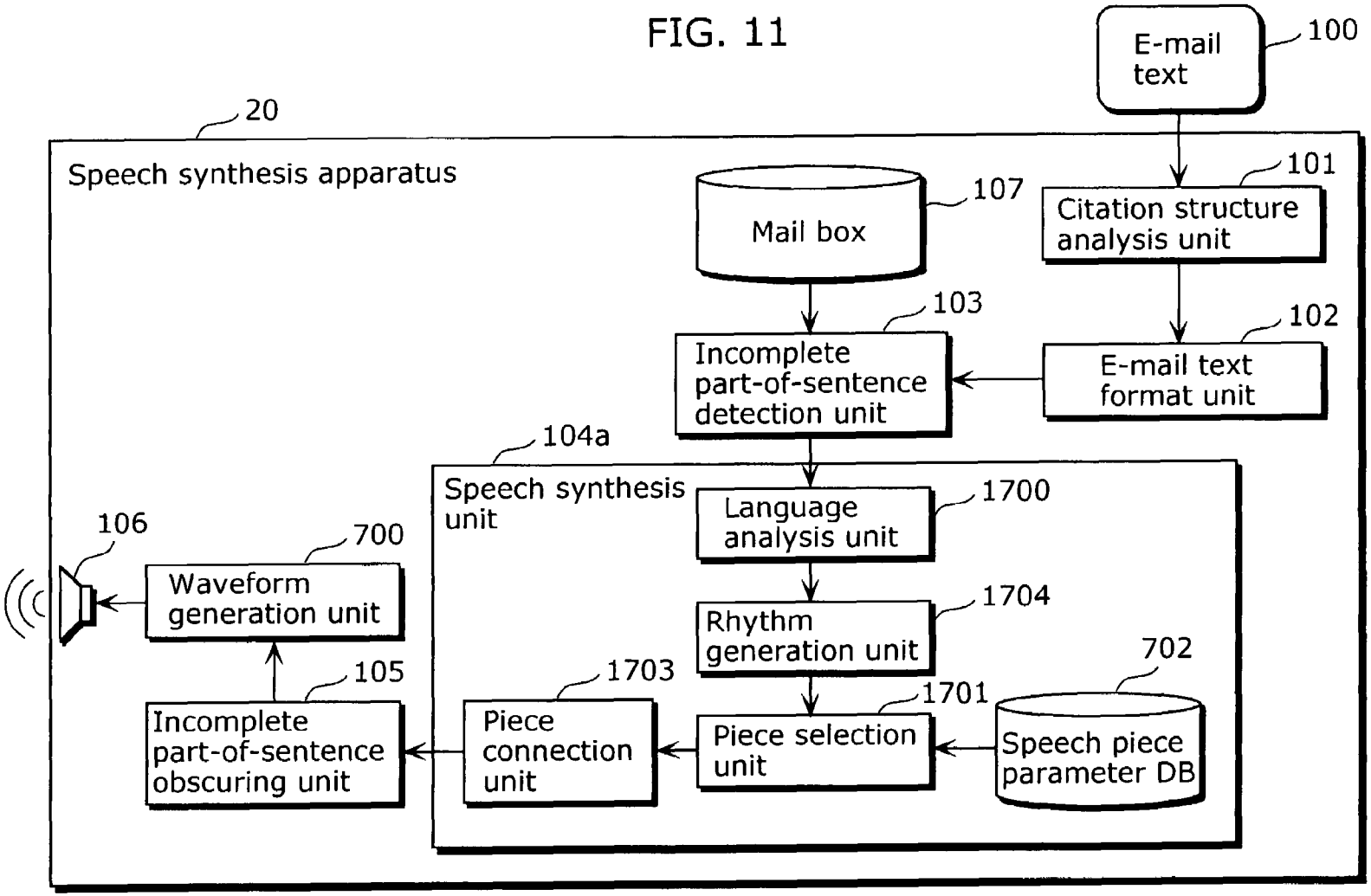
FIG. 11 is a block diagram indicating a functional configuration of a speech synthesis apparatus of a second embodiment.

FIG. 11 is a block diagram showing the functional configuration of the speech synthesis apparatus of the second embodiment. Note that the respective same components as the components of the first embodiment are shown with the same reference numbers, and the descriptions of them will be omitted.

The speech synthesis unit 104*a* in the speech synthesis apparatus 20 is different from the corresponding one in the above-described first embodiment in the following points. The speech synthesis unit 104*a* includes a speech piece parameter database (DB) 702 which stores speech pieces in a form of a speech feature parameter string instead of a form of speech waveform data. Its piece selection unit 1701 selects the speech pieces stored in this speech piece parameter DB 702, and its piece connection unit 1703 outputs the synthesized speech in a form of a speech feature parameter instead of a form of speech data.

In addition, in order to convert this output into a format for speech, the speech synthesis apparatus 20 of the second embodiment includes a waveform generation unit 700 which generates a speech waveform based on the speech feature parameter. The configuration of the waveform generation unit 700 varies depending on the speech feature parameter set to be employed by this apparatus. For example, it is possible to use a method based on ARX speech analysis models (Refer to "ONGEN PARUSU RETSU WO KORYO SHITA GANKEN NA ARX ONSEI BUNSEKI HO (Robust ARX Speech Analysis Method Based on Sound Source Pulse String)" by Otsuka and Kasuya, Acoustical Science and Technology, vol. 58, no. 7, 386-397 (2002)). In this case, the speech feature parameters of the respective speech pieces included in the speech piece parameter DB 702 become the sound source and vocal tract parameters of the ARX speech analysis models.

With the speech synthesis apparatus 20 of the second embodiment, it is possible to modify the speech feature parameter values instead of the speech waveform data in the incomplete part-of-sentence obscuring unit 105. Therefore, it provides the effect of being able to perform the processing for reducing acoustic clarity more flexibly. Here is an example case where there are parameters indicating the formant strength of the speech in the speech feature parameters which are outputted by the speech synthesis unit 104*a*. In this case, reducing the formant strength makes it possible to modify a voice tone into airy voice tone with obscure rhythm. In addition, in the case where a still higher technique for voice tone conversion is available here, the voice may be converted into a whispering voice or a husky voice.

Third Embodiment

Subsequently, a speech synthesis apparatus of a third embodiment of the present invention will be described.

The speech synthesis apparatus of the third embodiment is different from the speech synthesis apparatus of the first embodiment in that incomplete parts are obscured by modifying the voice tone of speech from natural voice tone into whispering voice tone in this third embodiment.

In addition, the speech synthesis apparatus of the third embodiment is different from the speech synthesis apparatus of the second embodiment in the following point. In the second embodiment, an obscuring processing for, for example, making speech into whispering voice is performed by modifying the speech feature parameter strings outputted by the speech synthesis unit 104*a*. However, in this third embodiment, the speech synthesis unit includes plural speech piece databases (DB). One of them accumulates normal voice pieces, and the other accumulates whispering voice pieces. Thus it becomes possible to selectively use normal voice and whispering voice by using these databases selectively.

Figure 12:
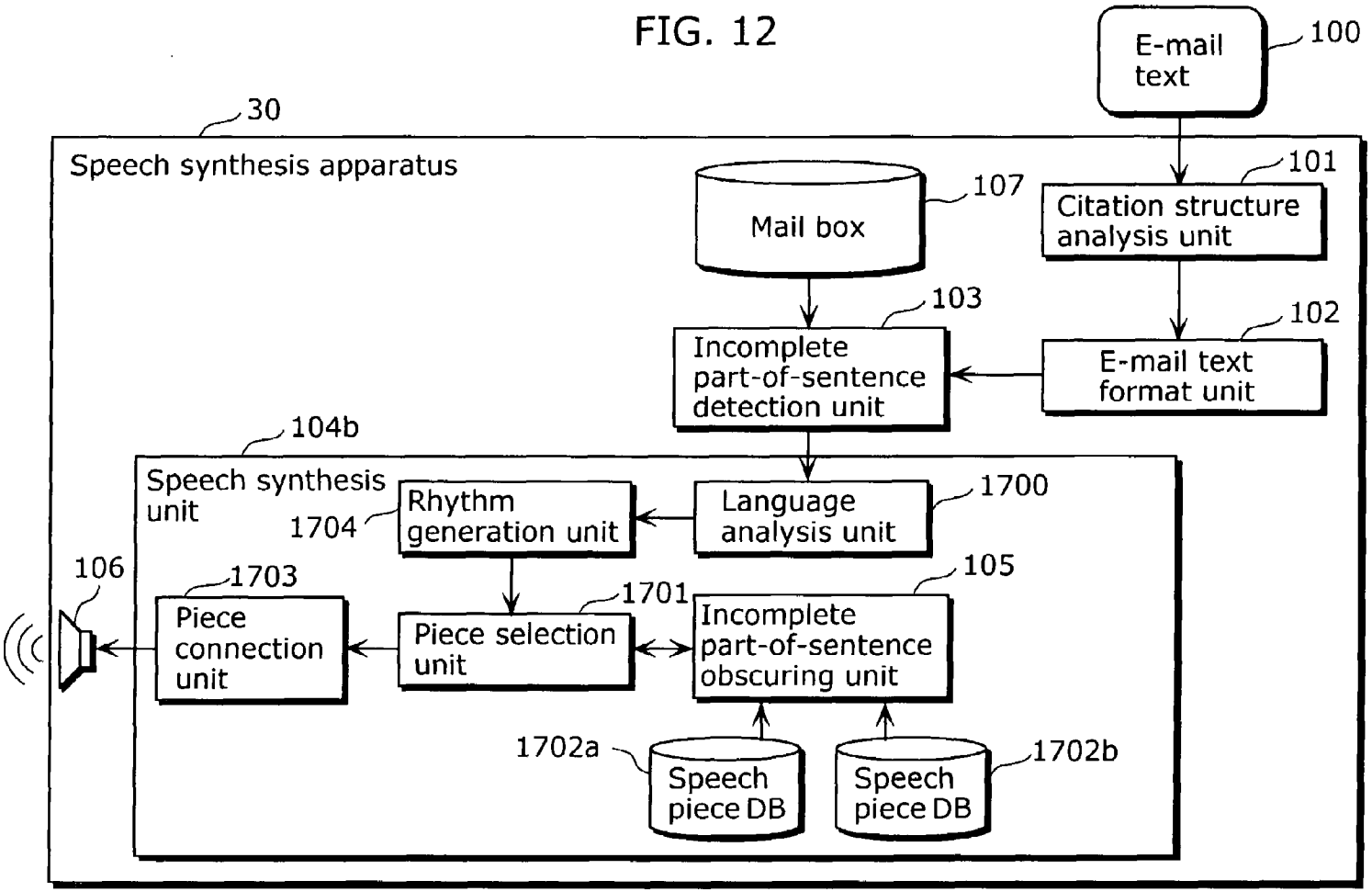
FIG. 12 is a block diagram indicating a functional configuration of a speech synthesis apparatus of a third embodiment.

FIG. 12 is a block diagram showing the functional configuration of the speech synthesis apparatus of the third embodiment. Note that the same components as the components in the first and second embodiments are provided with the same reference numbers, and the descriptions of them will be omitted.

First, the roles of the e-mail text 100 and the mail box 107 and the operations of the citation structure analysis unit 101, the e-mail text format unit 102, and the incomplete part-of-sentence detection unit 103 are the same as the corresponding ones in the first embodiment.

The speech synthesis unit 104*b* receives the result of the processing performed by the incomplete part-of-sentence detection unit 103, generates synthesized speech, and causes the speaker device 106 to play back and output the synthesized speech. The configuration of the speech synthesis unit 104*b* is different from the corresponding one in the first embodiment in that the incomplete part-of-sentence obscuring unit 105 operates as a part of the speech synthesis unit 104*b*.

Figure 13:
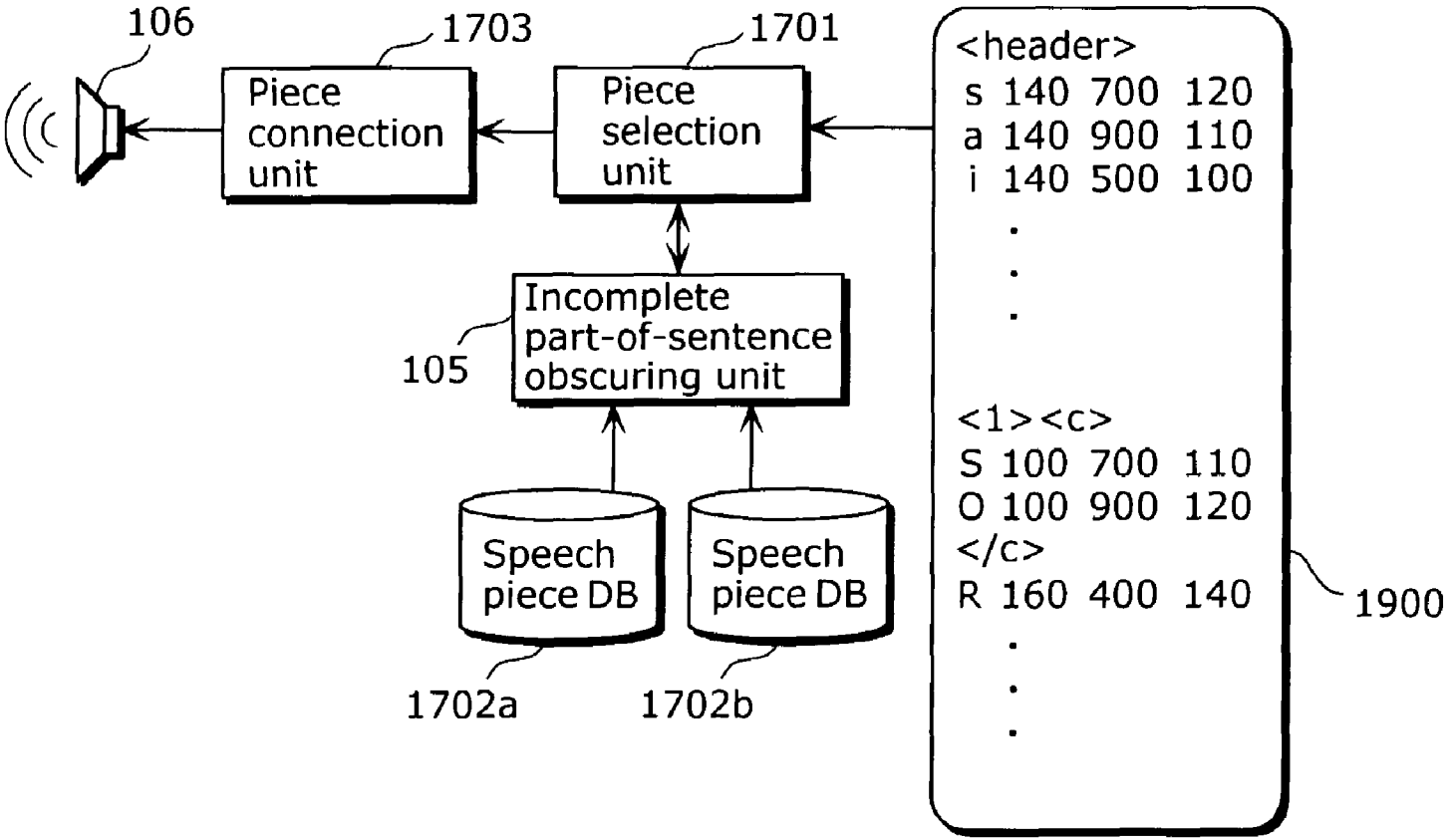
FIG. 13 is a diagram for illustrating example operations performed by the piece selection unit, the incomplete part-of-sentence obscuring unit and the piece connection unit.

Here will be described, with reference to FIG. 13, the processing performed by the piece selection unit 1701, the incomplete part-of-sentence obscuring unit 105 and the like in the speech synthesis unit 104*b* of the third embodiment.

The piece selection unit 1701 obtains the optimum speech piece data from the speech piece DB 1702*a* or the speech piece DB 1702*b* based on the information of the phoneme transcription text 1900 with rhythm which is outputted by the rhythm generation unit 1704. The speech piece DB 1702*a* stores speech pieces with a natural voice tone, and the speech piece DB 1702*b* stores speech pieces with a whispering voice tone. In this way, at least two types of databases are prepared. The piece selection unit 1701 obtains the optimum speech piece data from these speech piece DB 1702*a* and 1702*b* through the incomplete part-of-sentence obscuring unit 105.

The incomplete part-of-sentence obscuring unit 105 reads out the speech piece data which is requested by the speech piece selection unit 1701 and sends the read-out speech piece data to the piece selection unit 1701. In the case where the phoneme to be selected is included in the incomplete part, it is selected from the speech piece DB 1702*b* for whispering voice, and in the other case it is selected from the speech piece DB 1702*a* for natural voice tone.

Note that the incomplete part-of-sentence 105 can select speech pieces from one of the speech piece DBs 1702*a* and 1702*b* one-by-one, and furthermore it can select the optimum speech piece data from each of the speech piece DBs 1702*a* and 1702*b* one-by-one and mix them with each other so as to generate new speech piece data with an intermediate voice tone of the selected two types of speech piece data.

Further, the clarity of the speech may be changed in sequence by controlling the mixing ratio in such a manner performed in the first embodiment that fade-in and fade-out processing is performed by controlling the volume of speech.

Furthermore, a preferable result can be obtained by using an approach called speech morphing in addition to simply mixing the speech piece data. A voice tone control approach of speech based on speech morphing is disclosed in, for example, the Japanese Patent Publication 9-50295 and "KIHON SHUHASU TO SUPEKUTORU NO ZENJI HENKEI NI YORU ONSEI MOFINGU (Speech Morphing by Gradual Modification of Basic Frequency and Spectrum)", Abe, the acoustical society of Japan, the Proceedings of the Acoustical Society of Japan, autumn meeting, I, 213-214 (1995).

Speech pieces are selected according to the above-described method and then played back and outputted, to the speaker device 106, the speech data which is generated in the same manner performed in the first embodiment. This makes it possible to realize the speech synthesis apparatus which obscures the incomplete parts by modifying the voice tone of the speech into whispering voice tone.

Fourth Embodiment

Further, a speech synthesis apparatus of a fourth embodiment of the present invention will be described with reference to FIGS. 14 to 17.

The first to third embodiments describe the case of handling, as text information, the texts which are the contents communicated through e-mail. The fourth embodiment will describe a speech synthesis apparatus intended for handling, as text information, the messages which are the contents communicated through internet chat.

Figure 14:
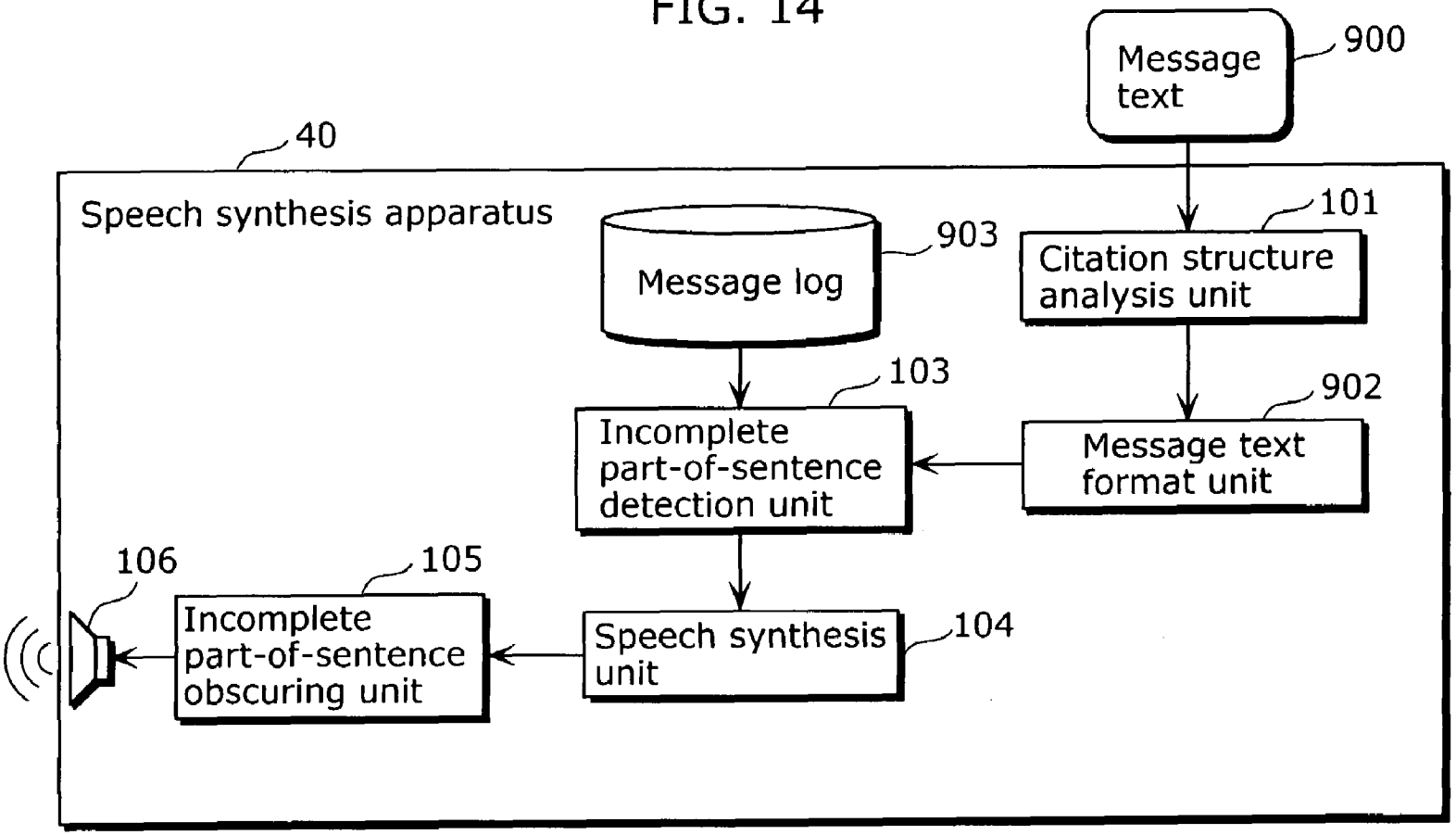
FIG. 14 is a block diagram indicating the configuration of a speech synthesis apparatus shown in a fourth embodiment.

FIG. 14 is a block diagram showing the functional configuration of a speech synthesis apparatus of the fourth embodiment. Note that the same components as the corresponding ones in the first to third embodiments are provided with the same reference numbers and the descriptions of them will be omitted.

As shown in FIG. 14, the speech synthesis apparatus 40 of the fourth embodiment regards the chat message text 900 as the target instead of the e-mail text 100. In general, the chat message text 900 has a form which is simpler than the form of e-mail text.

Figure 15:
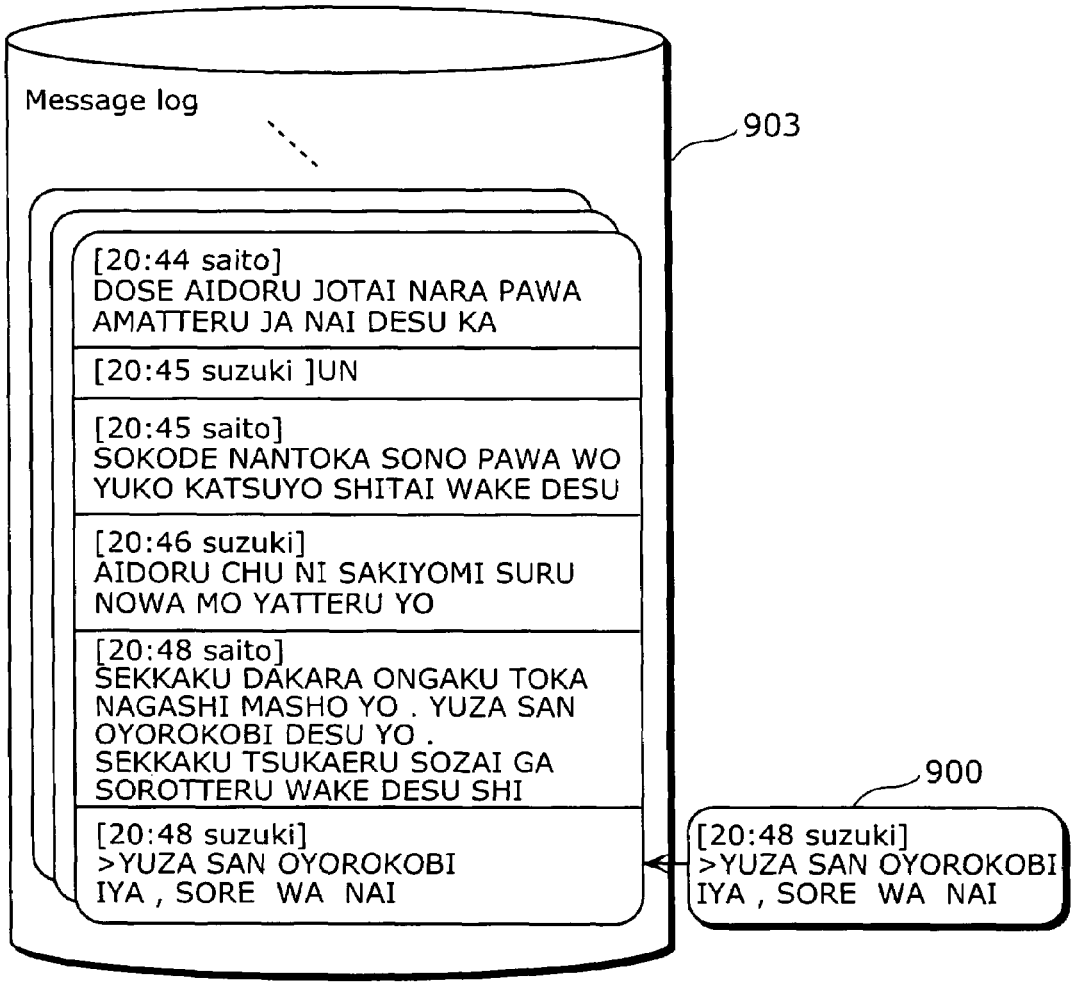
FIG. 15 is a schematic diagram indicating examples of message texts and message logs.
Figure 16:
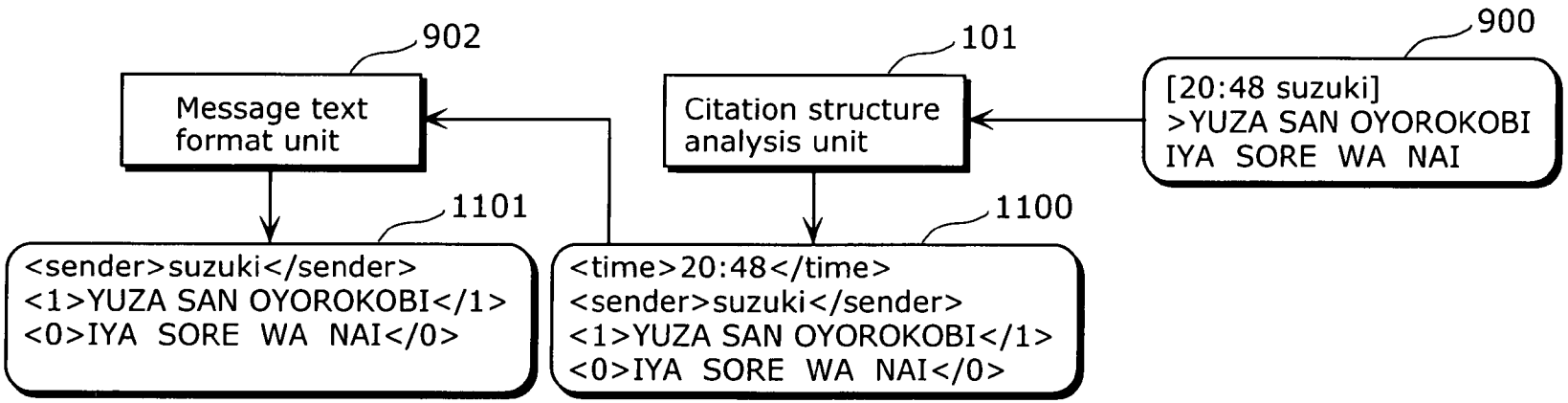
FIG. 16 is a schematic diagram indicating operations performed by the citation structure analysis unit and a message text format unit.

For example, as shown in FIG. 15, a conceivable structure of the chat message text 900 is the structure in which the followings are written in sequence: the receiving time; the name of the message sender; and the contents of the message written in a plaintext.

In addition, the received and sent chat message texts 900 are accumulated in the message log 903 and referable by the incomplete part-of-sentence detection unit 103.

The citation structure analysis unit 101 analyzes the citation structure of the chat message text 900 according to the method which is similar to the corresponding one in the first embodiment. The processing operation of the citation structure analysis unit 101 will be described with reference to FIG. 16. The processing operation of the citation structure analysis unit 101 may be performed in the following example manner.

1) It reads the character string of a chat message starting with the first character, obtains the receiving time and the sender's name which are enclosed by "[ ] (square bracket)", and encloses the receiving time by the tags <time> and </time> and the sender's name so as to separate them from each other.

2) It counts the number of citation symbols which are positioned in the starting part of the current line, and replaces the citation symbols with a tag indicating the number of citation symbols. Here are example cases. In the case where there is one citation symbol, it assigns "<1>" in place of the citation symbol. In the case where there are two citation symbols, it assigns "<2>" in place of these citation symbols. In the case where there is no citation symbol (the line is not cited), it assigns "<0>". Note that it does not close the tag at this time point. Hereinafter, the tag indicating the number of citation symbols is described as "citation tag", and the number of citation symbols is described as "citation level".

3) In the case where the current line is the last line of the chat message text 900, it closes the citation tag in order to complete the citation. For example, in the case where the current line is not the citation part, it adds "</0>" to the end of the line so as to complete this algorithm.

4) It starts to read the next line.

5) In the case where: the number of citation symbols varies between the current line and the line immediately before the current line; the current line is blank; the current line is a character string of "(CYURYAKU) (omitted in the middle)" and ":" which means that some original sentence are omitted there; the number of indents varies between the current line and the immediately-before line, it moves to the following 7).

6) It deletes the citation symbols in the starting part of the line, and moves to the above 3).

7) It closes the citation tag at the immediately-before line, and moves to the above 2).

According to 1) to 7), the text 1100 with an analyzed citation structure which is generated, and the text 1100 has the following features.

a) The receiving time information enclosed by the tags <time> and </time> and the sender's name enclosed by the tags <sender> and </sender> are present in the heading part of the message text, and the body part of the original chat message text 900 follows the heading part.

b) The body part is enclosed by citation tags on a paragraph-by-paragraph basis. Additionally, each citation tag shows a citation level.

Further, the message text format unit 902 processes the text 1100 with an analyzed citation structure, and generates the formatted text 1101. The message text format unit 902 generates the formatted text 1101 in the following way.

1) It gets rid of the tags <time> and </time>. Note that they may be maintained in the case of reading out the receiving time.

2) It deletes a line feed character and a blank from each of the sentences in the body part which is enclosed by the citation tags so as to make the sentences into a single-line text, and divides it into sentences by punctuations.

The incomplete part-of-sentence detection unit 103 receives the formatted text 1101 generated by the message text format unit 902. The incomplete part-of-sentence detection unit 103 collates the formatted text 1101 with the chat message texts which were accumulated in the past in the message log 903 so as to find the first chat message where the first sentence or the last sentence inside a pair of citation tags indicating a citation level of 1 or more. After that the incomplete part-of-sentence detection unit 103 determines whether each citation sentence is complete, in other words, whether no character strings of the original sentences are missing in the respective citation sentences, by means of character string matching. Further, in the case where the citation sentence is incomplete, the incomplete part-of-sentence detection unit 103 replaces the incomplete sentence by the complete original sentence and then makes the part cited from the complete original sentence identifiable.

The processing performed by the incomplete part-of-sentence detection unit 103 in the speech synthesis apparatus 40 of the fourth embodiment is obtained by simplifying the processing described in the first embodiment. The difference between this processing in the fourth embodiment and the processing described in the first embodiment will be listed below.

a) In the fourth embodiment, each of the chat message texts which were accumulated in the past in the message log 103 has a simple list structure, and therefore, no thread structure analysis is necessary while it is performed in the first embodiment. Sentences of the citation source may be searched by performing a matching between (a) the characters in the text other than the citation parts in the body part and (b) the characters of the chat message texts of the latest message and approximately 10 past chat messages.

b) In reading out chat messages, a message notifying "○○ SAN YORI MESSEIGI DESU (an incoming message from Mr./Ms. ○○)" is lengthy, since each chat message is shorter than a message in e-mail and messages are exchanged more often in chat than in e-mail. Instead of such a notification message, the sender of each message is represented by changing voice tones of synthesized speech on a sender-by-sender basis. This can be realized by, for example, preparing piece databases intended for plural types of voice tones in order to perform speech synthesis and using a different piece database for each speaker. Further, each citation part can be read out using the voice tone of the original sender by previously setting a property of "sender=SOSHINSHA" in the tag <c>, and previously writing sender's name of the original chat message text which is used as a citation sentence and which has been detected, in the message log 903, by the original incomplete part-of-sentence detection unit.

The speech synthesis unit 104 processes the text 1200 with detected incomplete part-of-sentence which has been generated in this way on a sentence-by-sentence basis starting with the first sentence, generates synthesized speech, and outputs the synthesized speech to the incomplete part-of-sentence obscuring unit 105. The voice tone of the synthesized speech which has been uniquely assigned to each message sender is used. In the case where there is a sender property in the <c> tag, the voice tone of the sender is used. In the case where there is no sender property, in other words, the citation source has not been detected, it is possible to use the voice tone of the latest sender of the message other than the sender of the message which is about to be read out.

Figure 17:
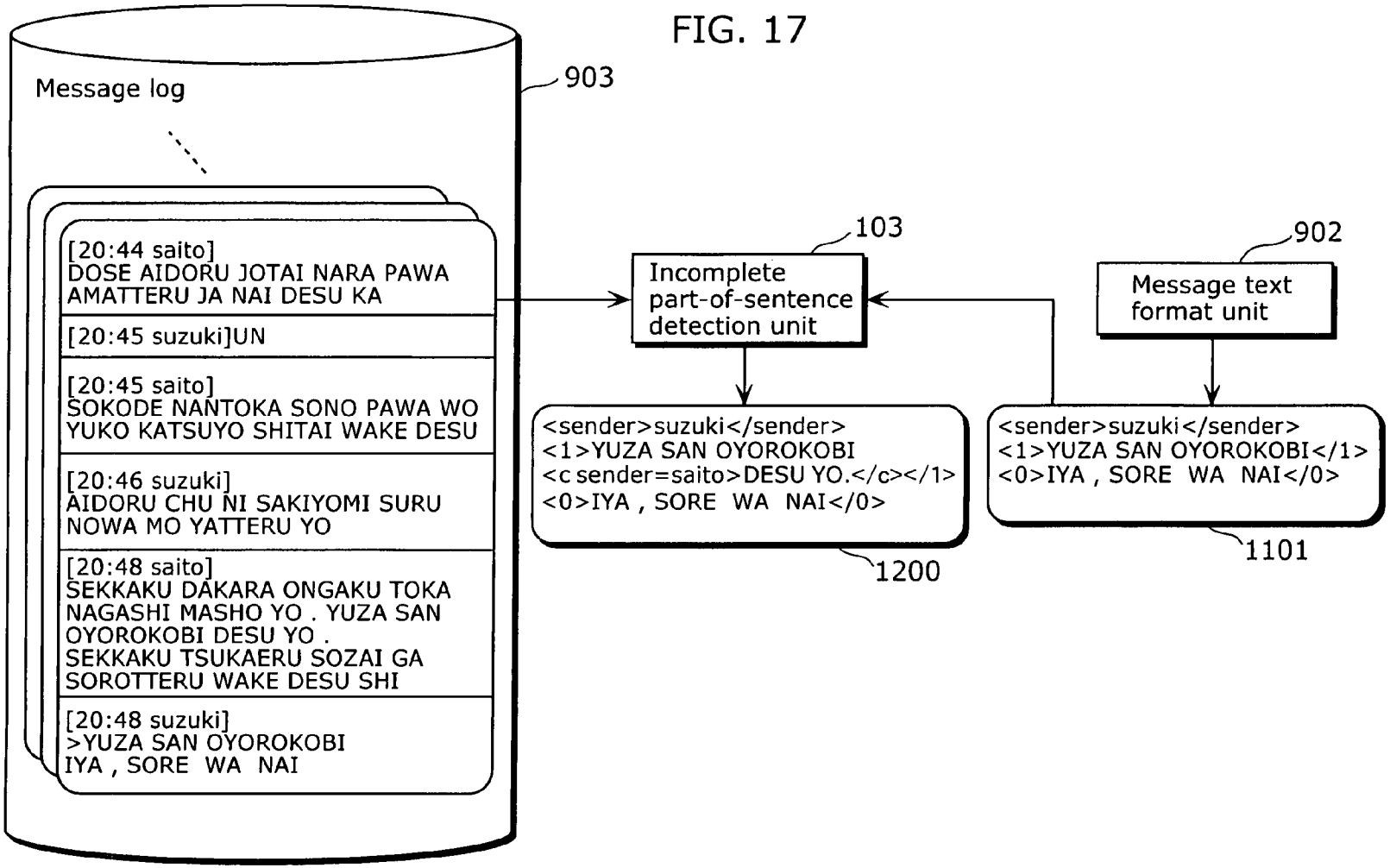
FIG. 17 is a schematic diagram indicating an operation performed by the incomplete part-of-sentence detection unit.

In FIG. 17, the sender of the message which is about to be read out is Suzuki, and the latest sender of the message other than Suzuki is Saito. Therefore, in the case where there is no sender property in the tag <c> of the text 1200 with detected incomplete parts-of-sentences, the voice tone assigned to Saito will be used for the synthesized speech corresponding to the part enclosed by the tags <c> and </c>.

The incomplete part-of-sentence obscuring unit 105 may perform the same processing as the processing performed in the first embodiment, and the description of the processing will be omitted.

The use of the method described above makes it possible to realize the speech synthesis apparatus which can read out chat message texts in a way that the messages are easy to understand for the users and the conversation flow is not inhibited.

Fifth Embodiment

Consequently, a speech synthesis apparatus of a fifth embodiment will be described.

The above embodiments 1 to 3 have described the case of handling e-mail texts as text information, and the forth embodiment has described the case of handling the chat messages as text information. This fifth embodiment will describe a speech synthesis apparatus in the case of handling a submitted message which is contents communicated through internet news as text information.

Figure 18:
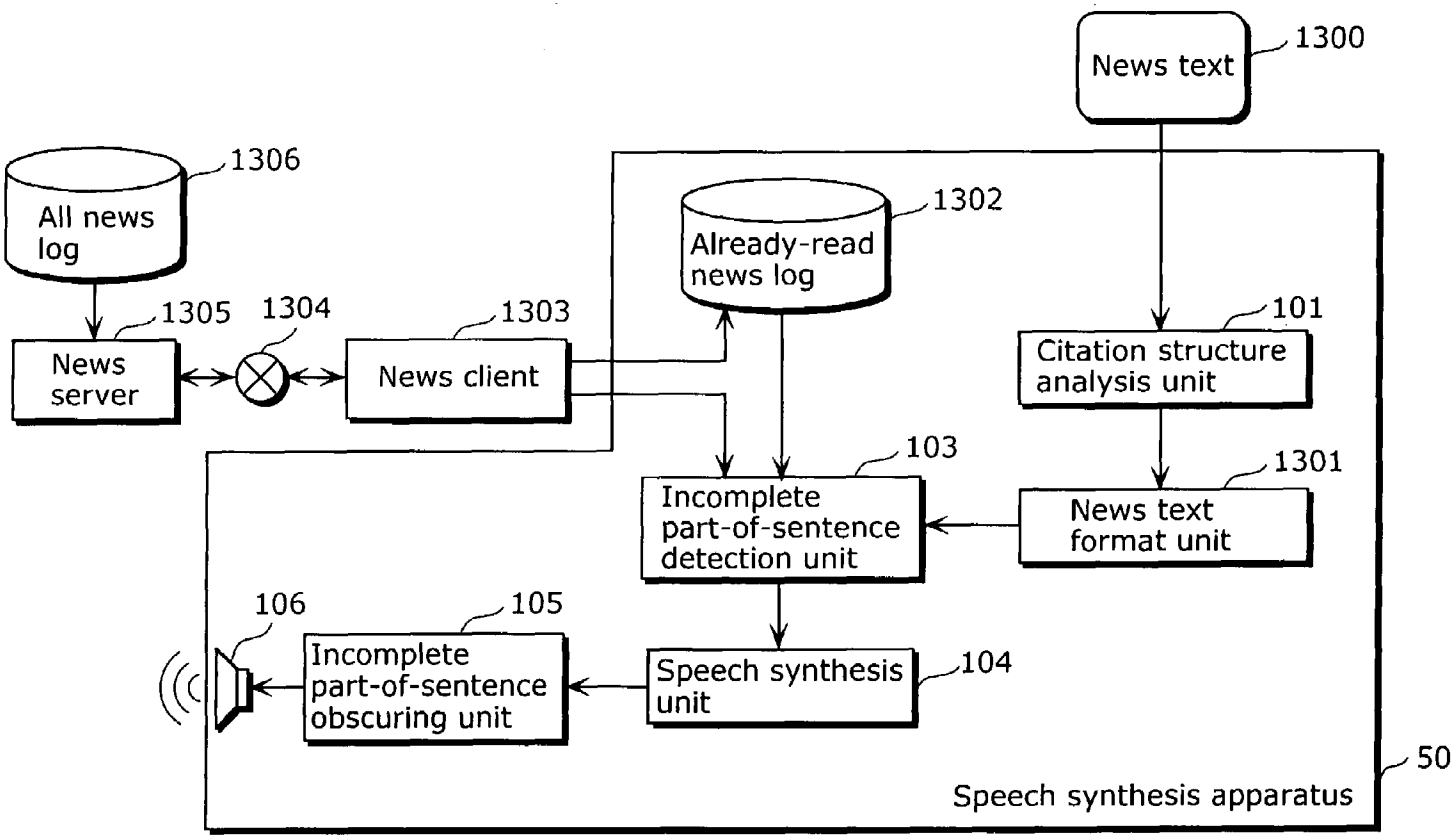
FIG. 18 is a block diagram indicating the functional configuration of a speech synthesis apparatus of a fifth embodiment.

The speech synthesis apparatus of the fifth embodiment performs approximately the same processing as the processing in the first embodiment. However, as shown in FIG. 18, the structure of the speech synthesis apparatus 50 of the fifth embodiment is different from the structure of the corresponding one in the first embodiment in the following points. Inputs are changed from the e-mail text 100 to a news text 1300. The e-mail text format unit 102 is replaced by a news text format unit 1301. The mail box 107 is replaced by an already-read news log 1302. Lastly, the incomplete part-of-sentence detection unit 103 is able to detect incomplete parts-of-sentences by accessing an all news log 1306 from a news server 1305 which can be connected through a news client 1303 and a network 1304, in addition to by accessing an already-read news log 1302. The operational differences between the speech synthesis apparatus 50 of this fifth embodiment and the corresponding one of the first embodiment will be described below.

Like the e-mail text 100, the news text 1300 includes a From field, a Subject filed, an In-Reply-To filed, a References field and the like. The news text 1300 is made up of a header part which is divided from the text by the line of "– – (two minus symbols)", and the following body part. The citation structure analysis unit 101 and the news text format unit 1301 perform the same processing as the processing performed by the citation structure analysis unit 101 and the e-mail text format unit 102 in the first embodiment.

The incomplete part-of-sentence detection unit 103 obtains a past news text in the thread which includes the news text 1300 from the already-read news log 1302, and searches the sentence of the citation source by performing the same processing as the processing performed in the first embodiment. Note that, in the case where the news text which appears in the References field of the header part of the news text 1300 is not present in the already-read news log 1302, it is possible to obtain the corresponding news text from the all news log 1306 using the news client 1303. The all news log 1306 is held by the news server 1305 connected through the network 1304. The obtainment of the news text is performed according to the same procedure as the operation of the present news client.

The operations of the speech synthesis unit 104 and the incomplete part-of-sentence obscuring unit 105 are the same as the operations performed in the first embodiment.

The above-described processing provides the same effect as the effect obtained in the first embodiment also in reading out internet news text.

Sixth Embodiment

Subsequently further, a speech synthesis apparatus of a sixth embodiment of the present invention will be illustrated.

The sixth embodiment will describe the speech synthesis apparatus in the case of handling, as text information, the messages submitted on the bulletin board on the network.

Figure 19:
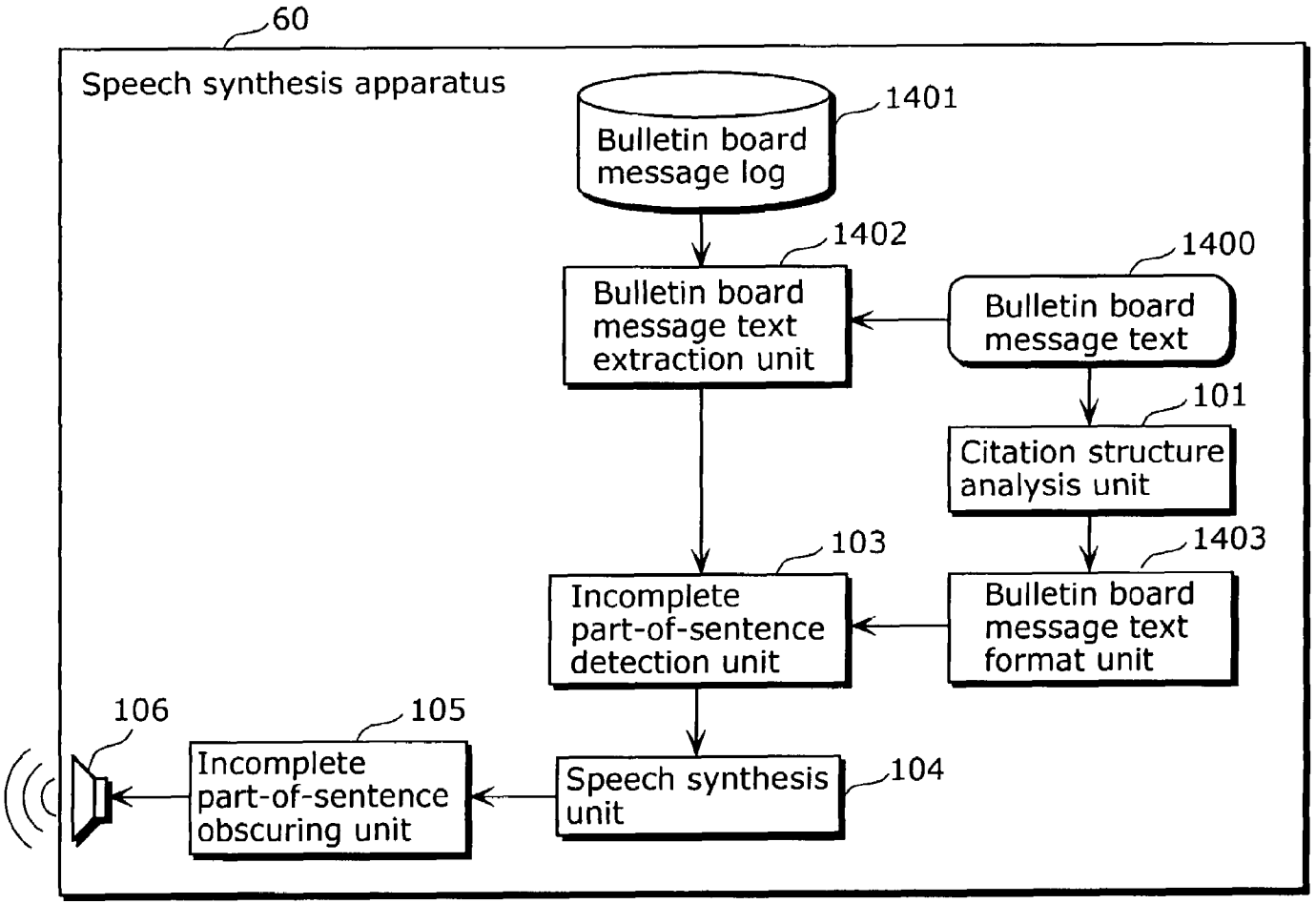
FIG. 19 is a block diagram indicating the functional configuration of a speech synthesis apparatus of a sixth embodiment.

FIG. 19 is a block diagram showing the functional structure of the speech synthesis apparatus of the sixth embodiment.

Unlike the cases of the first to fifth embodiments, the respective messages of the bulletin board message text do not have a divided independent structure. Therefore, the speech synthesis apparatus 60 of the sixth embodiment is required to extract a bulletin board message text 1400 to be read out and each past bulletin board message text from among the bulletin board message log 1401. Each past bulletin board message text is intended for reference by the incomplete part-of-sentence detection unit 103, and the bulletin board message log 1401 is intended for storing the bulletin board message texts. The bulletin board message text extraction unit 1402 performs this extraction processing. The operation of the extraction processing performed by the bulletin board message text extraction unit 1402 will be described with reference to FIG. 20.

Figure 20:
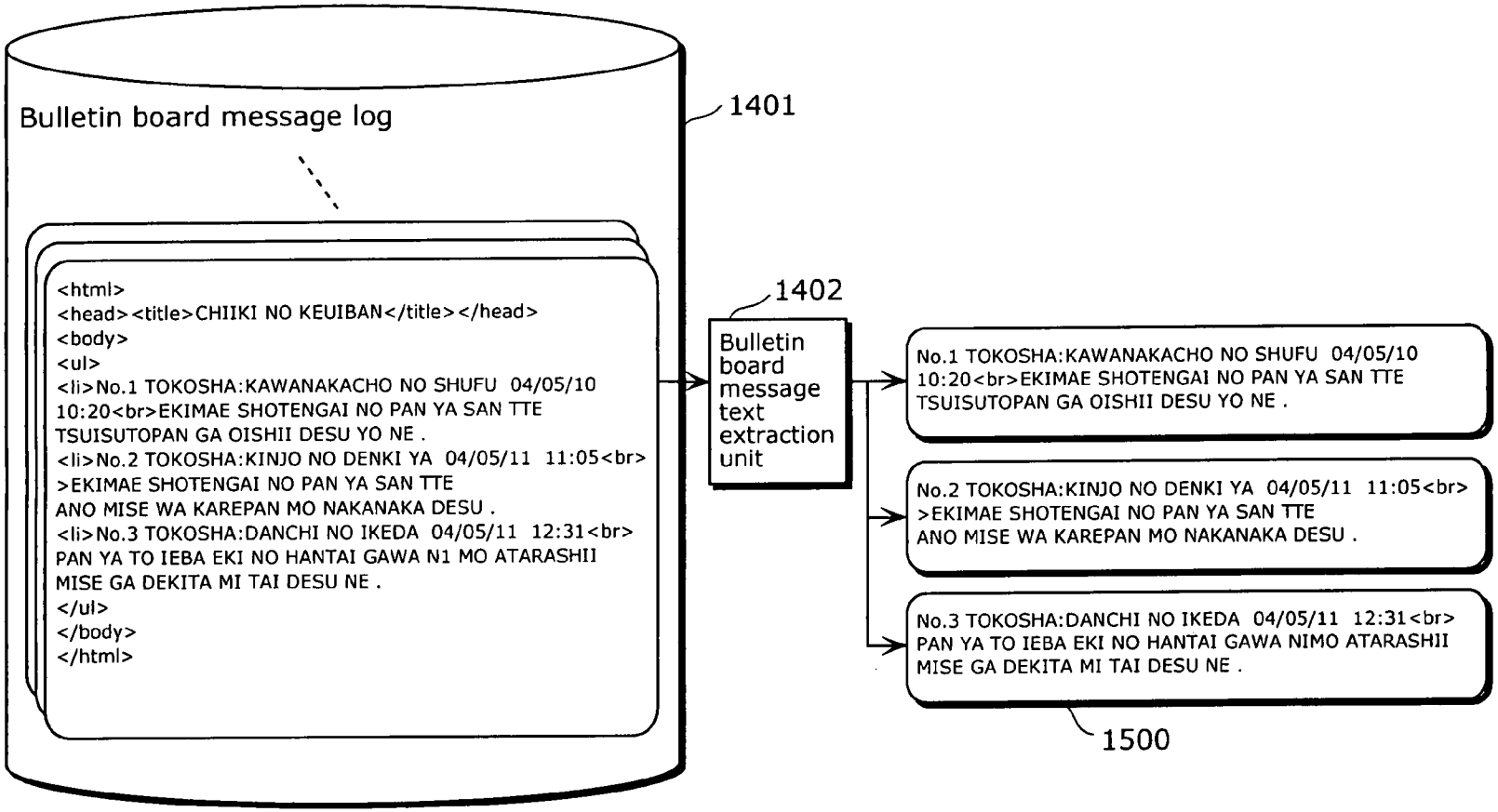
FIG. 20 is a diagram illustrating an example operation performed by a bulletin board message text extraction unit.

As shown in the example of FIG. 20, the bulletin board message log 1401 is written in HTML (Hyper Text Markup Language) so as to be viewed through a WWW browser, and has the following format.

a) The whole bulletin board message log 1401 is enclosed by the tags <html> and </html>. The header part is enclosed by the tags <head> and </head>. The body part is enclosed by the tags <body> and </body>.

b) The title of the bulletin board is written in the part which is enclosed by the tags <title> and </title> in the header part.

c) The body part includes the tags <ul> and </ul> and each submitted message is listed with a <li> tag.

d) In the first line of the submitted message, the serial article number, submitter's name, and the submission time are written using a fixed format, the first line is fed by a <br> tag, and in the following part the text of this submission is written.

The bulletin board message text extraction unit 1402 processes an HTML document having a format like this in the following way.

1) It further cuts out the text enclosed by the tags <ul> and </ul> inside the tags <body> and </body>.

2) It divides the part cut out in 1) of the text into pieces of submission at the respectively corresponding <li> tags.

The respective submitted texts divided in this way are regarded as divided bulletin message texts 1500. The latest message on this bulletin board is read out, for example, in the following way.

1) The bulletin message text extraction unit 1402 extracts the latest message from among the divided bulletin message texts 1500 as the bulletin message text 1400 to be read out, and sends it to the citation structure analysis unit 101.

2) The citation structure analysis unit 101 processes the part enclosed by the tags <body> and </body> of the bulletin message text 1400 using the same method as the method used in the first embodiment, and assigns citation tags.

Figure 21:
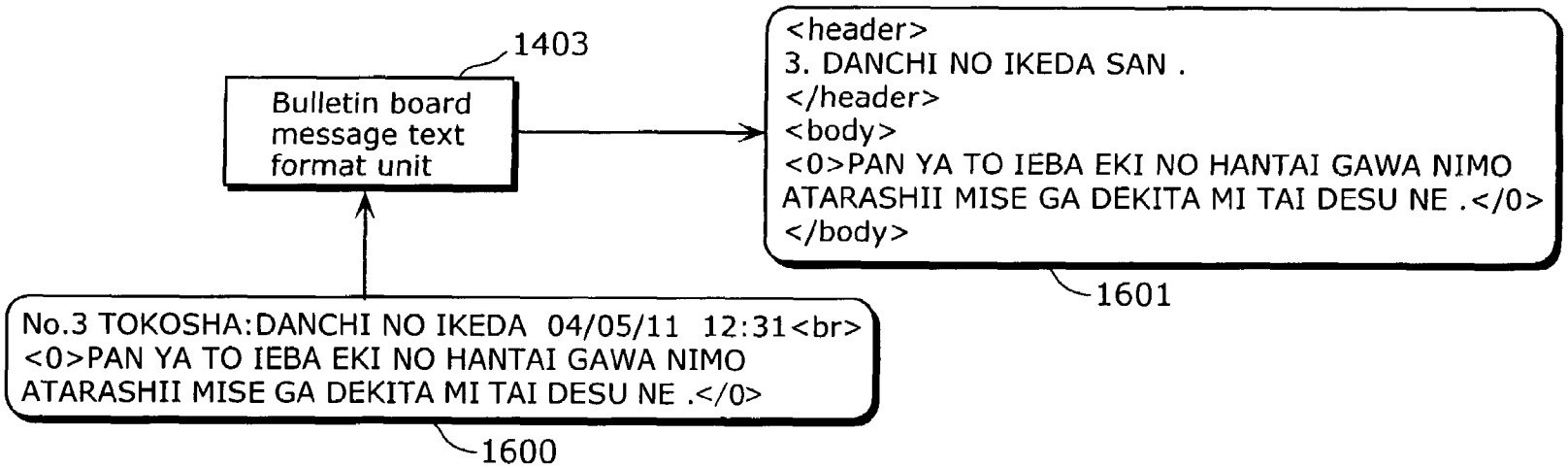
FIG. 21 is a diagram illustrating an example operation performed by a bulletin board message text format unit.

3) The bulletin board message text format unit 1403, as shown in FIG. 21, generates a sentence representing the serial article number and the submitter's name to be read out based on the first line of the text 1600 with an analyzed citation structure which is generated as the processing result of 2). After that, it encloses the generated sentence by the tags <header> and </header>, and encloses the second line and the following lines by tags <body> and </body> so as to generate the formatted text 1601.

4) According to the same method as the method used in the first embodiment, the incomplete part-of-sentence detection unit 103 searches a citation sentence included in the formatted text 1601 from among the message texts before the bulletin board message text 1400 to be read out included among the divided bulletin board message texts 1500. After that, it complements the sentence with a complement character string.

5) The speech synthesis unit 104 and the incomplete part-of-sentence obscuring unit 105 generate synthesized speech and play back the synthesized speech by performing the same processing as the processing in the first embodiment.

The processing described above can provide the same effect obtained in the first embodiment in reading out the texts written in an HTML format on the bulletin board on a WWW browser.

The speech synthesis apparatuses of the present invention have been described based on the respective embodiments up to this point.

In this way, the speech synthesis apparatus of the present invention includes a speech synthesis unit which generates synthesized speech data based on an input of a text, and further includes: an incomplete part-of-sentence detection unit which can detect the incomplete parts of sentences; and an incomplete part-of-sentence obscuring unit which reduces the acoustic clarity of a part of the audio data to be generated by the speech synthesis unit. The part of the audio data corresponds to the incomplete part detected by the incomplete part-of-sentence detection unit.

In other words, the incomplete part-of-sentence detection unit analyses the linguistically incomplete parts among the inputted text based on which speech synthesis is performed, and sends the analysis result to the speech synthesis unit. At this time, it is desirable that the incomplete part-of-sentence detection unit send the analysis result of the syntax. This is because sending the analysis result enables the speech synthesis unit to generate synthesized speech without performing syntax analysis again. In the case where the speech synthesis unit generates synthesized speech based on the linguistic analysis result of the inputted texts and the synthesized speech contains an incomplete part, it also outputs incomplete part-of-sentence pointer information indicating the incomplete part of the generated synthesized speech so as to send the information to the incomplete part-of-sentence obscuring unit. The incomplete part-of-sentence obscuring unit performs the processing for reducing the acoustic clarity of the part indicated by the incomplete part-of-sentence pointer information included in the synthesized speech, and outputs the part as the read-out speech data of the inputted text.

In this way, the part which has a linguistic meaning is read out as usual, and the part which does not have any meaning is read out with a reduced acoustic clarity. Thus, it becomes possible to prevent user confusion.

Here, the speech synthesis unit may output speech feature parameters which are sufficient for generating synthesized speech instead of synthesized speech itself. These speech feature parameters include model parameters, LPC Cepstrum coefficients and sound source model parameters in the source-filter type speech generation model. Enabling the incomplete part-of-sentence obscuring unit to adjust the speech feature parameters which are obtained in the step before the step of generating synthesized speech data instead of synthesized speech data in this way makes it possible to perform obscuring processing of the incomplete parts more flexibly.

In addition, in the case where the contents of the language analysis processing performed by the incomplete part-of-sentence detection unit includes the contents of the language analysis processing which is required for enabling the speech synthesis unit to generate synthesized speech, the speech synthesis unit may not receive inputs of the inputted text and the result of language analysis based on the inputted text performed by the incomplete part-of-sentence detection unit. In other words, the speech synthesis unit may receive an input of only the result of language analysis based on the inputted text performed by the incomplete part-of-sentence detection unit.

In addition, even in the case where the incomplete part-of-sentence detection unit does not send the language analysis result to the speech synthesis unit, the speech synthesis unit can send the detection result of the incomplete part-of-sentence to the speech synthesis unit by embedding the detection result in the inputted text. For example, enclosing all of the incomplete parts-of-sentences in the inputted texts by tags and sending the enclosed parts-of-sentences to the speech synthesis unit enables the speech synthesis unit to obtain both the information of the inputted text and the detection result of the incomplete parts-of-sentences from the incomplete part-of-sentence detection unit. In this way, it becomes unnecessary for the speech synthesis unit to synchronize the two types of inputs which are provided separately.

In addition, the incomplete part-of-sentence obscuring unit can reduce the clarity of the speech corresponding to the incomplete part-of-sentence by superimposing a noise on the speech corresponding to the incomplete part-of-sentence or adding a sound effect such as reducing the volume of speech of the incomplete part-of-sentence. In this way, it is possible to clearly notify a user that an incomplete part-of-sentence, which cannot be read out correctly because of the linguistic incompleteness, is present in the text to be read out.

In addition, the incomplete part-of-sentence obscuring unit may change the obscuring degree of speech in time sequence. As to the incomplete part of the starting part of a line, the obscuring degree is set at the maximum level at the starting part of the speech, and the obscuring degree is reduced in time sequence so that the obscuring degree becomes its minimum level at the ending part of the incomplete part. In contrast, as to the incomplete part of the ending part of a line, the obscuring degree is increased in time sequence. In this way, it becomes possible to allow a user to listen to more natural synthesized speech.

In addition, it is possible to obscure not only the speech of the incomplete parts but also the speech of the other parts. It is also possible to set a certain time constant and perform processing of obscuring the part of the speech corresponding to the time constant or obscuring the part including an incomplete part of speech corresponding to at least the time constant. In the case of changing the obscuring degree in time sequence, performing the processing like this makes it possible to control the obscuring degree not to increase dramatically even in the case where the length of an incomplete part is short, and thus it is possible to provide speech which is further acoustically natural.

In addition, in the case where the text to be read out is sentences in mail, the following procedures make it possible to replace incomplete sentences by the original complete sentences temporarily so as to analyze the sentences correctly and read out the sentences with original right rhythm: previously preparing a citation structure analyzing unit which analyzes the citation structure of the mail text and divides the cited text on a sentence-by-sentence basis, and further previously preparing the mail box accumulating the mail texts which were sent and received in the past and a complete sentence search unit which can access the mail box and search the original complete sentence including the incomplete part-of-sentence from among the past mail texts.

Here, the speech synthesis unit may perform speech synthesis of all the original complete sentences detected by the complete sentence search unit and output the synthesized speech, or may output only the parts of the cited texts based on the speech synthesis result of the original complete sentences. In addition, it is possible to previously set a predetermined time constant, and cut out a part of the cited sentence which is to be subjected to obscuring processing so that the part corresponds to the length of the time constant at the maximum, based on the result of the speech synthesis of the original complete sentence.

In addition, in the case where it is possible to obtain the original complete text which includes a target of reading-out, it is possible to obtain the same effect by preparing a complete sentence obtainment unit which obtains the original complete text.

Note that the present invention is not limited to these embodiments, and it is of course possible to provide various transformations and modifications in suit to the essence of the present invention without deviating from the scope of the present invention.

INDUSTRIAL APPLICABILITY

The present invention is applicable to, for example, a text reading-out application intended for reading out text data of e-mail and the like using a speech synthesis technique, and a personal computer to which such an application is installed. The present invention is particularly useful in the use of reading out text data including text to be read out in which incomplete sentences are highly likely to appear.

What is claimed is:

1. A speech synthesis apparatus which generates synthesized speech corresponding to inputted text information, said apparatus comprising:

an incomplete part-of-sentence detection unit operable to detect from among the text information a part-of-sentence which is linguistically incomplete because of a missing character string in the part-of-sentence;

an incomplete part-of-sentence obscuring unit operable to reduce an acoustic clarity of the synthesized speech corresponding to the incomplete part-of-sentence detected by said incomplete part-of-sentence detection unit;

a complementation unit operable to complement the detected incomplete part-of-sentence with a complement character string; and a speech synthesis unit operable to generate the synthesized speech based on the text information complemented by said complementation unit.

2. The speech synthesis apparatus according to claim 1, wherein said incomplete part-of-sentence obscuring unit is operable to reduce the acoustic clarity of the synthesized speech by adding at least one of the following acoustic effects to the synthesized speech:

reduction of a volume of the synthesized speech;

addition of a predetermined sound effect to the synthesized speech; and modification of a voice tone of the synthesized speech.

3. The speech synthesis apparatus according to claim 1, wherein said incomplete part-of-sentence obscuring unit is operable to modify in time sequence a degree of the acoustic effect which is added to the synthesized speech, as a method of reducing the acoustic clarity.

4. The speech synthesis apparatus according to claim 1, wherein the text information is a communicated content, said speech synthesis apparatus further comprising, a log accumulation unit which has a storage area for accumulating communicated contents, said incomplete part-of-sentence detection unit is operable to detect the incomplete part-of-sentence of the text information by comparing the text information with contents communicated in the past and accumulated in said log accumulation unit, and said complementation unit is operable to complement the detected incomplete part-of-sentence with the contents communicated in the past and accumulated, based on a result of the detection by said incomplete part-of-sentence detection unit.

5. The speech synthesis unit according to claim 4, wherein said incomplete part-of-sentence detection unit is further operable to:

analyze a language structure of a predetermined language string including a missing character string in the text information; and detect one of (a) the missing character string only and (b) the predetermined language string including the missing character, as the incomplete-part-of-sentence.

6. The speech synthesis apparatus according to claim 4, wherein the communicated content is one of the following:

an e-mail text;

a chat message text;

a message text submitted to an Internet news program; and a message text submitted to a bulletin board.

7. A speech synthesis method for generating synthesized speech corresponding to inputted text information, said method comprising:

detecting from among the text information a part-of-sentence which is linguistically incomplete because of a missing character string in the part-of-sentence;

reducing an acoustic clarity of the synthesized speech corresponding to the incomplete part-of-sentence detected in said detecting;

complementing the detected incomplete part-of-sentence with a complement character string; and generating the synthesized speech based on the text information complemented in said complementing.

8. A program intended for a speech synthesis apparatus which generates synthesized speech corresponding to inputted text information, said program causing a computer to execute:

detecting from among the text information a part-of-sentence which is linguistically incomplete because of a missing character string in the part-of-sentence;

reducing an acoustic clarity of the synthesized speech corresponding to the incomplete part-of-sentence detected in said detecting;

complementing the detected incomplete part-of-sentence with a complement character string; and generating the synthesized speech based on the text information complemented in said complementing.

* * * * *